US010493521B2

(12) United States Patent
Nakata et al.

(10) Patent No.: US 10,493,521 B2
(45) Date of Patent: Dec. 3, 2019

(54) DIE CASTING MACHINE

(71) Applicant: Toshiba Kikai Kabushiki Kaisha, Tokyo (JP)

(72) Inventors: Kouei Nakata, Zama (JP); Satoru Aida, Tokyo (JP); Toshiaki Toyoshima, Zama (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 212 days.

(21) Appl. No.: 15/583,395

(22) Filed: May 1, 2017

(65) Prior Publication Data

US 2017/0326630 A1 Nov. 16, 2017

(30) Foreign Application Priority Data

May 10, 2016 (JP) ..... 2016-094766

(51) Int. Cl.
*B22D 17/00* (2006.01)
*B22D 17/10* (2006.01)
(Continued)

(52) U.S. Cl.
CPC ..... *B22D 17/007* (2013.01); *B22D 17/002* (2013.01); *B22D 17/10* (2013.01);
(Continued)

(58) Field of Classification Search
CPC .... B22D 17/00; B22D 17/002; B22D 17/007; B22D 17/10; B22D 17/20; B22D 17/203; B22D 17/26; B22D 17/32
(Continued)

(56) References Cited

U.S. PATENT DOCUMENTS 4,493,362 A * 1/1985 Moore et al. ..... B22D 17/32 164/113
5,758,707 A 6/1998 Jung et al.
(Continued)

FOREIGN PATENT DOCUMENTS

CN 1436653 8/2003
CN 1509829 7/2004
(Continued)

OTHER PUBLICATIONS

English Language Abstract and Translation of JP 2014-217865 published Nov. 20, 2014.
(Continued)

*Primary Examiner* — Kevin P Kerns
(74) *Attorney, Agent, or Firm* — DLA Piper LLP US

(57) ABSTRACT

A die casting machine includes a clamping device which opens and closes and clamps a pair of die halves, an injection apparatus which performs injection to the pair of die halves by making a plunger move forward in a sleeve communicated with a space between the pair of die halves, and a control device which controls the clamping device and injection apparatus. The control device includes an injection control part and press-use clamping control part. The injection control part controls the injection apparatus so as to start the injection in a state where the pair of die halves face each other through a gap. The press-use clamping control part controls the clamping device so that the die contact and clamping are carried out after the start of injection. Further, the injection control part performs control for decelerating the plunger before the plunger stops.

8 Claims, 11 Drawing Sheets

(51) Int. Cl.
*B22D 17/20* (2006.01)
*B22D 17/26* (2006.01)
*B22D 17/32* (2006.01)

(52) U.S. Cl.
CPC ..... *B22D 17/203* (2013.01); *B22D 17/26* (2013.01); *B22D 17/32* (2013.01)

(58) Field of Classification Search
USPC ..... 164/155.1, 303, 312, 314, 342, 343
See application file for complete search history.

(56) References Cited

U.S. PATENT DOCUMENTS

| | | | | |
|---|---|---|---|---|
| 2004/0256073 | A1* | 12/2004 | Kubota ..... | B22D 17/14 164/65 |
| 2013/0255902 | A1* | 10/2013 | Tomioka et al. ..... | B22D 17/00 164/154.8 |
| 2016/0001357 | A1 | 1/2016 | Abe et al. | |

FOREIGN PATENT DOCUMENTS

| | | |
|---|---|---|
| CN | 1607053 | 4/2005 |
| CN | 102069171 | 5/2011 |
| CN | 105312534 | 2/2016 |
| JP | S58-9758 | 1/1983 |
| JP | 2000-280277 | 10/2000 |
| JP | 2011-067838 | 4/2011 |
| JP | 2014-217865 | 11/2014 |
| JP | 2015-116599 | 6/2015 |
| JP | 2016-013565 | 1/2016 |
| KR | 2004-0028876 | 4/2004 |
| TW | 201433434 | 9/2014 |
| TW | 201529204 | 8/2015 |

OTHER PUBLICATIONS

English Language Abstract and Translation of JP 2011-067838 published Apr. 7, 2011.
English Language Abstract of TW 201529204 published Aug. 1, 2015.
English Language Abstract of TW 201433434 published Sep. 1, 2014.
English Language Abstract of JP S58-9758 published Jan. 20, 1983.
Korean Office Action issued in KR Application No. 10-2017-0022784 dated Dec. 15, 2017.
English Language Abstract of KR 2004-0028876 published Apr. 3, 2004.
English Language Abstract of JP 2000-280277 published Oct. 10, 2000.
Chinese Office Action issued in CN Application No. dated Oct. 12, 2018.
Chinese Office Action issued in CN Application No. 201710111258.2 dated Jul. 3, 2019.

* cited by examiner

201

DIE CASTING MACHINE

CROSS REFERENCE TO RELATED APPLICATIONS

This application claims priority to Japanese Application No. 2016-094766 filed May 10, 2016. The entirety of all the above-listed applications are incorporated herein by reference.

TECHNICAL FIELD

The present disclosure relates to a die casting machine and a molding method of a solid-liquid coexisting metal. Note that, a "solid-liquid coexisting metal" may be either of a semi-solidified metal exhibiting a solid-liquid coexisting state by cooling of a liquid-state metal or a semi-molten metal exhibiting a solid-liquid coexisting state by heating of a solid metal.

BACKGROUND ART

Known in the art is a technique of casting a solid-liquid coexisting metal. For example, Patent Literature 1 discloses a die casting machine having the same configuration as that of a usual die casting machine for casting a liquid-state metal (molten metal) wherein casting is carried out by supplying a semi-solidified metal to a sleeve communicated with a space between clamped die halves and injecting the semi-solidified metal in the sleeve into the space in the die halves by a plunger. Further, Patent Literature 2 discloses casting by conveying a semi-molten metal into the space between opened die halves (without injection) and then clamping the die halves.

Note that, not in a field concerned with the casting of solid-liquid coexisting metal, but a field concerned with the molding of resin, there is known a so-called "injection/compression molding method" of injecting a molten resin into the space between mold halves which are opened a little and then clamping to perform the molding.

CITATION LIST

Patent Literature

Patent Literature 1: Japanese Patent Publication No. 2014-217865A

Patent Literature 2: Japanese Patent Publication No. 2011-67838A

SUMMARY OF INVENTION

Technical Problems

When casting a solid-liquid coexisting metal, if applying a relatively high pressure to the solid-liquid coexisting metal, the primary crystals are compressed and the structure can be densified. That is, the quality of the product can be improved. On the other hand, in the configuration as in Patent Literature 1 of applying pressure to a solid-liquid coexisting metal by a plunger, it is difficult to give sufficient pressure to the solid-liquid coexisting metal. Further, in the configuration as in Patent Literature 2 of conveying a solid-liquid coexisting metal to the space between the opened die halves and clamping to give pressure to the solid-liquid coexisting metal, the opening direction is limited to the vertical direction, and a device dedicated to casting the solid-liquid coexisting metal must be configured.

Accordingly, preferably provision is made of a die casting machine and molding method of a solid-liquid coexisting metal capable of suitably giving pressure to the solid-liquid coexisting metal.

Solution to Problem

A die casting machine according to one aspect of the present disclosure includes a clamping device which opens and closes and clamps a pair of die halves, an injection apparatus which performs injection to the pair of die halves by moving a plunger forward in a sleeve communicated with a space between the pair of die halves, and a control device which controls the clamping device and the injection apparatus. The control device includes an injection control part which controls the injection apparatus so that the injection is started in a state where the pair of die halves face each other through a gap, and a press-use clamping control part which controls the clamping device so that die contact and clamping are carried out after the start of injection. The injection control part performs such control so that the plunger is decelerated before the plunger stops.

Preferably, the injection control part performs control for decelerating the plunger before rise of the injection pressure due to filling of the solid-liquid coexisting metal into the space between the pair of die halves approaching completion.

Preferably, the injection control part performs control for stopping the plunger as the control for decelerating the plunger.

Preferably, the machine is further provided with a electrical connection sensor which outputs a signal in accordance with conduction of current at a predetermined position in the die halves. The injection control part starts control for decelerating the plunger at the time when detecting the conduction of current based on a signal from the electrical connection sensor.

Preferably, the die halves forms a product part and overflow part inside it. The predetermined position is a position in the overflow part which is separated from the end part of the overflow part toward the product part side.

Preferably, the machine is further provided with a temperature sensor which outputs a signal in accordance with the temperature in a product part of the die halves. The press-use clamping control part starts the control for die contact and clamping at the time when detecting a drop in the temperature in the product part down to a predetermined pressing start temperature based on the signal from the temperature sensor.

Preferably, the machine is further provided with a temperature sensor which outputs a signal in accordance with the temperature in the die halves. The injection control part starts the control for decelerating the plunger at the time when detecting a rise of the temperature in the die up to a predetermined deceleration start temperature based on the signal from the temperature sensor.

Preferably, the press-use clamping control part starts the control for die contact and clamping at the time when detecting a drop of the temperature in the die down to a predetermined pressing start temperature based on the signal from the temperature sensor.

Preferably, the machine is further provided with a position sensor which outputs a signal in accordance with the position of the plunger. The injection control part starts the control for decelerating the plunger when detecting that the position of the plunger reaches a predetermined deceleration start position based on the signal from the position sensor.

Preferably, the injection control part starts the control for decelerating the plunger when detecting that a predetermined period of time has passed from a predetermined point of time after the start of injection.

Preferably, the machine is further provided with a speed sensor which outputs a signal in accordance with the speed of the plunger. The injection control part starts the control for decelerating the plunger at the time when detecting a drop of the speed of the plunger to a predetermined deceleration starting speed lower than a target speed based on the signal from the speed sensor in a state where performing control so that the plunger moves forward toward the die halves at the target speed.

Preferably, the machine is further provided with a pressure sensor which outputs a signal in accordance with the injection pressure. The injection control part starts the control for decelerating the plunger when detecting a rise of the injection pressure up to a predetermined deceleration starting pressure based on the signal from the pressure sensor in a state where performing control so that the plunger moves forward toward the die halves at a predetermined target speed.

A method for casting a solid-liquid coexisting metal according to another aspect of the present disclosure comprising an injection step of controlling a driving part which drives a plunger so as to extrude the solid-liquid coexisting metal in the sleeve communicated with the pair of die halves by the plunger into the space between the pair of die halves which face each other through a gap, and a press-use clamping step of clamping the pair of die halves into which the solid-liquid coexisting metal is injected. In the injection step, the control for decelerating the plunger is performed before the plunger stops.

Advantageous Effects of Invention

According to the above configurations or procedure, pressure can be suitably given to the solid-liquid coexisting metal.

DESCRIPTION OF EMBODIMENTS

First Embodiment (Overall Configuration of Die Casting Machine)

Figure 1:
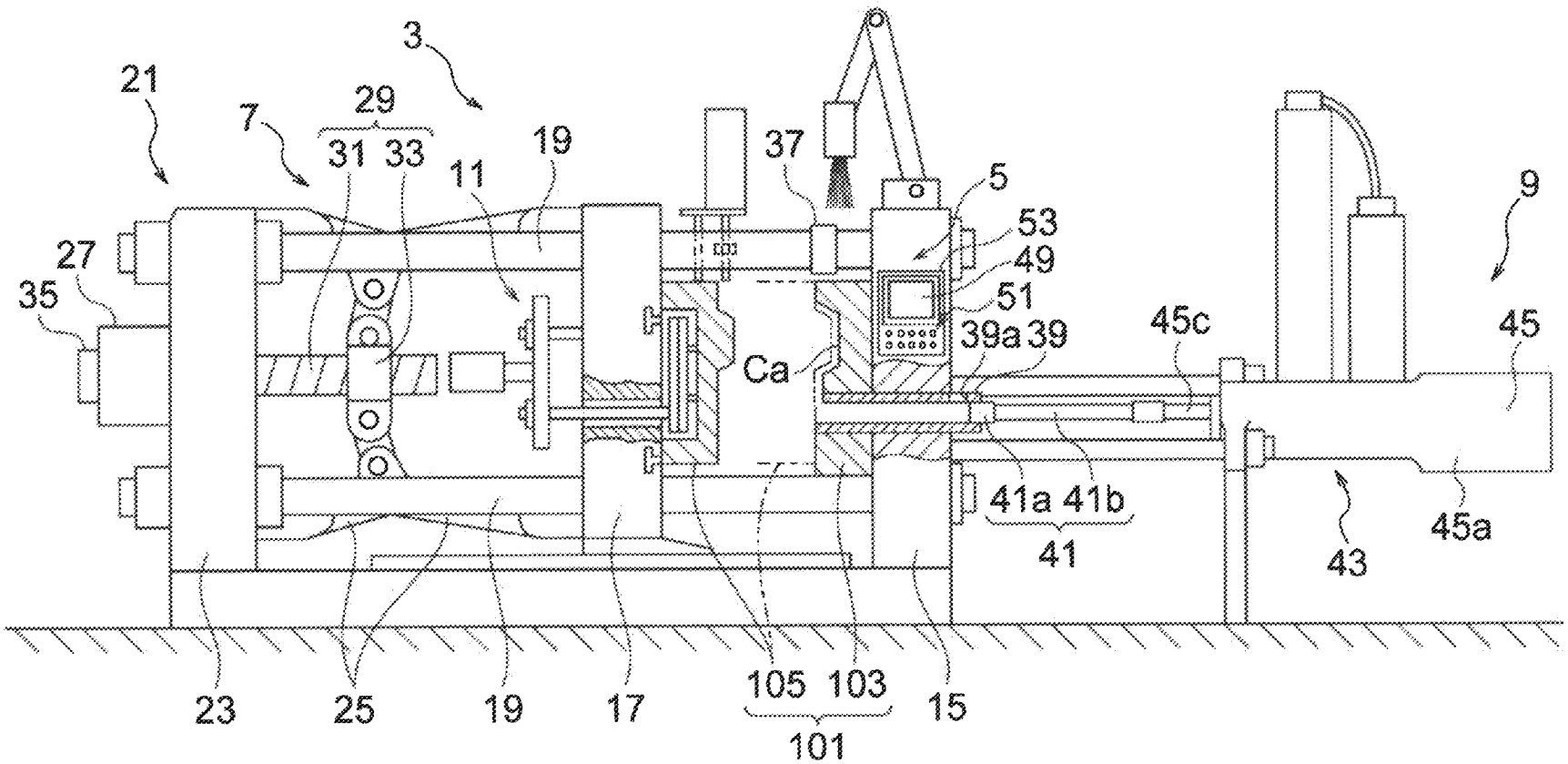
FIG. 1 is a side view showing the configuration of a principal part of a die casting machine according to a first embodiment of the present disclosure.

FIG. 1 is a side view, partially including a cross-sectional view, which shows the configuration of a principal part of a die casting machine according to a first embodiment of the present disclosure.

A die casting machine 1 is an apparatus which injects a liquid-state metal (molten metal) or solid-liquid coexisting metal into a die 101 (space such as cavity Ca, same true in the following description) and causes the metal to solidify in the die 101 to thereby manufacture a die casting. Note that, the die casting machine 1 can be used for casting both liquid-state metal and solid-liquid coexisting metal. However, in the following explanation, mainly the configuration and procedure concerning casting semi-solidified metal, an example of the solid-liquid coexisting metal, will be explained. The metal is for example aluminum or aluminum alloy.

The die 101 for example includes a fixed die half 103 and movable die half 105. In the explanation of the present embodiment, for convenience, the cross-section of the fixed die half 103 or movable die half 105 is indicated by one type of hatching. However, these die halves may be formed by direct carving or may be insert types. Further, a core or the like may be combined with the fixed die half 103 and movable die half 105.

The die casting machine 1 for example has a machine body 3 which performs a mechanical operation for casting and a control unit 5 which controls the operation of the machine body 3. The machine body 3 for example has a clamping device 7 which opens/closes and clamps the die 101, an injection apparatus 9 which injects a semi-solidified metal to an internal portion of the die 101, and an ejection device 11 which ejects the die casting from the fixed die half 103 or movable die half 105 (movable die half 105 in FIG. 1). Further, the machine body 3 has a supply device 13 (see FIG. 2) which supplies the semi-solidified metal to the injection apparatus 9.

In the die casting machine 1, the configurations other than the supply device 13 and control unit 5 (for example configurations of clamping device 7 and injection apparatus 9) may be the same as various known compositions for casting by injecting a liquid-state metal or solid-liquid coexisting metal. Further, the configuration of the supply device 13 may be made the same as the configurations of various known semi-solidified metal supply devices.

The clamping device 7, for example, as a fundamental configuration, has a fixed die plate 15 holding the fixed die half 103, a moving die plate 17 holding the movable die half 105, and one or more (usually two or more, for example, four) tie bars 19 which bridged the two die plates.

The fixed die plate 15 and the moving die plate 17 are arranged so as to face each other and hold the fixed die half 103 and movable die half 105 on the facing side thereof (front surface side). By the moving die plate 17 being moved in the facing direction (opening/closing direction) with respect to the fixed die plate 15, the die 101 is opened/closed. Further, for example, in a state where the die 101 is closed (die contact) (indicated by two dotted chain line), the portions on the moving die plate 17 side in the tie bars 19 fixed to the fixed die plate 15 are pulled to the back of the moving die plate 17 (left side on the drawing sheet). Due to this, a clamping force (force fastening the die 101) is obtained in accordance with the amount of extension of the tie bars 19.

Further, the clamping device 7, for example, has an electric and toggle type clamping driving part 21 as a driving part for realizing the opening/closing and clamping of the die. Specifically, the clamping driving part 21 for example has a link housing 23 which is positioned behind the moving die plate 17, a plurality of links 25 which link the link housing 23 and the moving die plate 17, and a clamping electric motor 27 which gives a driving force to the plurality of links 25.

The link housing 23 is fixed to the left side portions of the tie bars 19 on the drawing sheet. Further, as explained above, the right side portions of the tie bars 19 on the drawing sheet are fixed to the fixed die plate 15. Accordingly, when a driving force is given to the plurality of links 25 by the clamping electric motor 27, and the link housing 23 and the moving die plate 17 are separated from each other, the moving die plate 17 moves toward the fixed die plate 15 and closes the die. Addition of the driving force is continued even after die contact and movement of the moving die plate 17 to the fixed die plate 15 side being restricted. Accordingly, the tie bars 19 are pulled to the back of the moving die plate 17, therefore a clamping force is generated.

The clamping electric motor 27 is for example a rotary electric motor. The rotation of the clamping electric motor 27 is for example converted to translation motion by a screw mechanism 29 and is transmitted to the links 25. The screw mechanism 29 for example has a screw shaft 31 which is restricted in movement in the axial direction with respect to the link housing 23 and is rotated around the axis by the clamping electric motor 27 and has a nut 33 (crosshead) which is screwed with the screw shaft 31, connected to the links 25, and restricted in rotation around the axis.

Further, the clamping device 7 has an encoder 35 which detects the rotation of the clamping electric motor 27 and a clamping force sensor 37 which detects the clamping force.

The encoder 35 may be an incremental type or absolute type. The encoder 35 and/or control unit 5 can detect relative positions of the moving die plate 17 and the link housing 23 (the portions of the tie bars 19 on the link housing 23 side) by cumulatively adding the number of pulses generated in the encoder 35. Accordingly, the encoder 35 can detect the position of the moving die plate 17 before the die contact and can detect the elongation of the tie bars 19 after the die contact.

The clamping force sensor 37 for example includes a strain gauge, is attached to a portion in the tie bars 19 which is expanded in the clamping, and generates a signal in accordance with the strain of the tie bars 19. The clamping force sensor 37 and/or control unit 5 can calculate the clamping force based on the generated signal (strain) and information of the tie bars 19. The information of the tie bars 19 used for calculation of the clamping force is for example the number, Young's Modulus, and cross-sectional area (diameter) of the tie bars 19.

The injection apparatus 9 for example has a sleeve 39 communicated with the interior of the die 101, a plunger 41 capable of sliding in the sleeve 39, and an injection driving part 43 which drives the plunger 41. Note that, in the explanation of the injection apparatus 9, sometimes the die 101 side will be referred to as the "front," and the side opposite to the former will be referred to as the "rear".

By sliding forward the plunger 41 in the sleeve 39 from the illustrated position in a state where the semi-solidified metal is arranged in the sleeve 39, the semi-solidified metal is extruded (injected) into the die 101. After that, by the solidification of the semi-solidified metal in the die 101, a die casting is formed.

The sleeve 39 is for example a tubular member which is connected to the fixed die half 103 and has a supply port 39*a* for receiving the metal material in the sleeve 39 opened in its upper surface. Note that, in a case where the sleeve 39 is dedicated to solid-liquid coexisting metal, the supply port 39*a* may be configured by a notch formed by cutting the rear end of the upper surface of the sleeve 39 as well. The plunger 41 has a plunger tip 41*a* capable of sliding in the front-back direction in the sleeve 39 and a plunger rod 41*b* having a tip end fixed to the plunger tip 41*a*.

The injection driving part 43 is for example a hydraulic pressure type and is configured including an injection cylinder 45. The injection cylinder 45 has a cylinder part 45*a* and a piston rod 45*c* which extends to the front of the cylinder part 45*a* and is connected to the rear end of the plunger rod 41*b*. The plunger 41 is driven by that the piston rod 45*c* being driven in the axial direction with respect to the cylinder part 45*a*.

The control unit 5 for example has a control device 47 (see FIG. 4) which performs various computations and outputs control commands, a display device 49 which displays an image, and an input device 51 which receives an input operation by an operator. Further, from another viewpoint, the control unit 5 for example has a not shown control panel having a power supply circuit and control circuit and so on and an operation part 53 as a user interface.

The control device 47 is for example provided on a not shown control panel and operation portion 53. The control device 47 may be configured suitably divided or dispersed. For example, the control device 47 may include a lower level control device for each of the clamping device 7, injection apparatus 9, ejection device 11, and semi-solidified metal supply device 13, and a higher level control device which performs control for synchronizing these lower level devices.

The display device 49 and input device 51 are for example provided in the operation portion 53. The operation portion 53 is for example provided in the fixed die plate 15 of the clamping device 7. The display device 49 is for example configured by a touch panel including a liquid crystal display or organic EL display. The input device 51 is for example configured by mechanical switches and the touch panel.

(Configuration of Supply Device of Semisolidified Metal)

Figure 2:
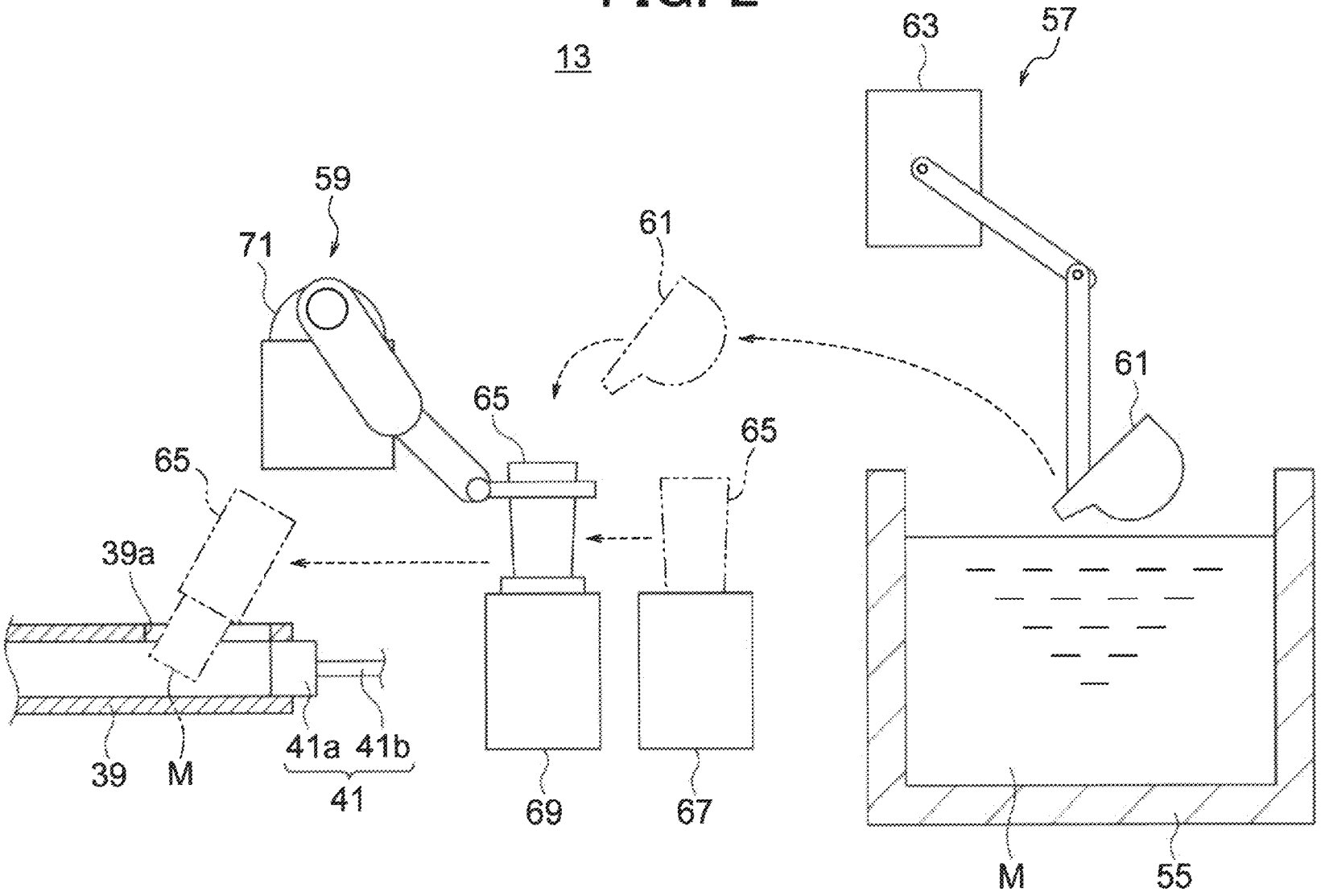
FIG. 2 is a schematic diagram showing an example of a semi-solidified metal supply device of the die casting machine in FIG. 1.

FIG. 2 is a schematic diagram showing an example of the supply device 13 which supplies the semi-solidified metal to the injection apparatus 9.

The supply device 13 is configured as a device producing a semi-solidified state metal material M from a liquid-state metal material M and supplying the same to the sleeve 39. The supply device 13 for example has a holding furnace 55 holding the liquid-state metal material M, a pouring device 57 which dips out the liquid-state metal material from the holding furnace 55, and a semi-solidification device 59 into which the liquid-state metal material is poured by the pouring device 57 to solidify the poured liquid-state metal material up to the semi-solidified state.

The holding furnace 55 and pouring device 57 may be given for example substantially same configurations as the known configurations for pouring the liquid-state metal material into the sleeve 39 in a die casting machine for casting a general liquid-state metal material. The holding furnace 55 for example holds the metal material in the furnace body opened in its upper surface and heats that metal material to hold it in liquid-state. Note that, the holding furnace 55 may act also as a melting furnace. The pouring device 57 for example includes a ladle 61 and a ladle carrying device 63 for carrying the ladle 61 and dispenses one shot's worth of the liquid-state metal material from the holding furnace 55.

The semi-solidification device 59 for example has a vessel 65 into which the liquid-state metal material M is poured by the pouring device 57, a preliminary cooling unit 67 for cooling the vessel 65 before pouring the liquid-state metal material into the vessel 65, a mounting apparatus 69 on which the vessel 65 is placed when the liquid-state metal material M is poured into the vessel 65, and a vessel carrying device 71 which carries the vessel 65.

The vessel 65 is for example a substantially tubular member. The vessel 65 may have a closed bottom or open bottom. The preliminary cooling unit 67 cools the vessel 65 by for example dipping the vessel 65 in a cooling medium. The cooling medium may be gas or liquid. The mounting apparatus 69 for example circulates the cooling medium under a placement surface on which the vessel 65 is placed and thereby cools the vessel 65 from the lower part. Note that, the placement surface of the mounting apparatus 69 configures the bottom of the vessel when the vessel 65 has an open bottom. The vessel carrying device 71 is for example configured by an articulated robot.

When the vessel 65 cooled by the preliminary cooling unit 67 is conveyed onto the mounting apparatus 69 by the vessel carrying device 71, the liquid-state metal is poured from the ladle 61 into the vessel 65 by the pouring device 57. The liquid-state metal is stripped of heat and cooled by the vessel 65 and agitated by flow when it is poured. Due to this, the semi-solidified metal is manufactured. Further, the vessel 65 is conveyed onto the supply port 39*a* of the sleeve 39 by the vessel carrying device 71, and the semi-solidified metal drops into the sleeve 39 from the vessel 65. Due to this, the semi-solidified metal is supplied to the injection apparatus 9.

(Sensor Provided in Die)

Figure 3A:
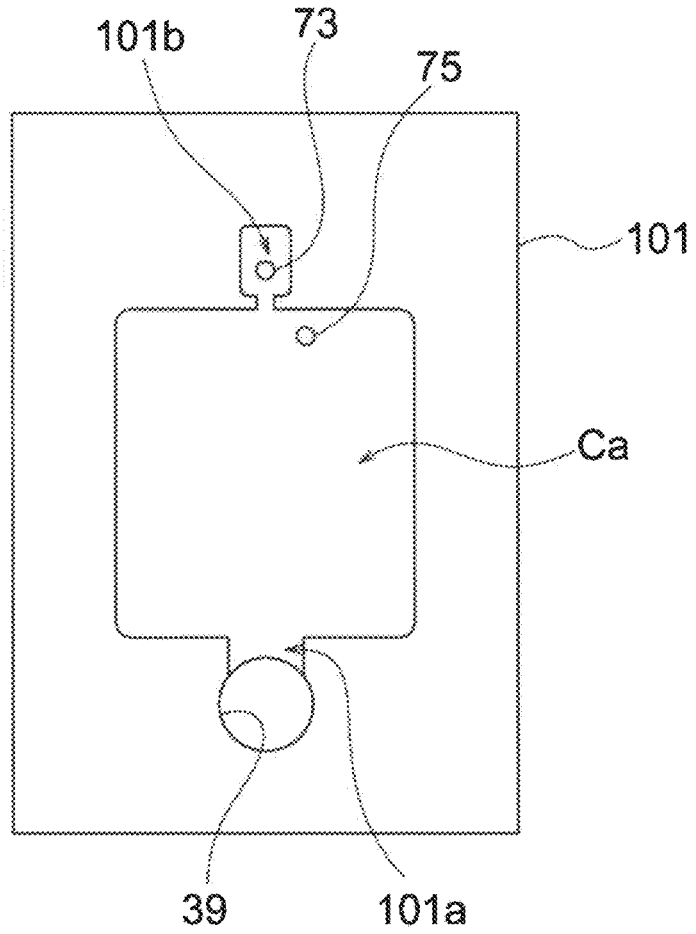
FIG. 3A and FIG. 3B are schematic diagrams showing various types of sensors in the die casting machine in FIG. 1.

FIG. 3A is a schematic transparent view when viewing the die 101 in the opening/closing direction.

A concave portion is formed in at least one of the surface on the movable die half 105 side in the fixed die half 103 or the surface on the fixed die half 103 side in the movable die half 105. Therefore, when the die 101 is closed, a space is formed in the die 101. This space for example has a passageway 101*a* (runner) extending from the casting port (sleeve 39), cavity Ca (product part), and overflow part 101*b* (basin).

The passageway 101*a* is the portion of guiding the semi-solidified metal to the cavity Ca. The cavity Ca is the portion for forming the product. The overflow part 101*b* is for example a portion holding a surplus semi-solidified metal. Note that, although not particularly shown, a vent may extend from the overflow part 101*b* as well.

The shapes of these may be suitably set in accordance with the shape of the product. Further, in the illustrated example, one cavity Ca is formed in one die 101. However, a plurality of cavities Ca may be formed in one die 101 as well. One overflow part 101*b* may be provided for one cavity Ca, or two or more may be provided for one cavity Ca. The overflow part 101*b*, compared with that in a die to which a molten metal is injected, may be formed so as to have a large cross-sectional area in the contact part with respect to the cavity Ca (for example thick in the opening/closing direction).

The die 101 has an overflow part 101*b* which the semi-solidified metal enters when the semi-solidified metal substantially fills the cavity Ca (below, this is designated when simply referred to as the "overflow part 101*b*"). Such an overflow part 101*b* is for example connected to the portion in the outer edge of the cavity Ca at which the semi-solidified metal arrives last.

For example, the connection position of the overflow part 101*b* to the cavity Ca is located on the opposite side to the connection position (gate) of the passageway 101*a* to the cavity Ca. The "opposite side" referred to here may be for example the lower side and upper side of the cavity Ca in the horizontally clamped die 101. Further, for example, the connection position of the overflow part 101*b* to the cavity Ca is a position in the outer edge of the cavity Ca where the length of the route (for example the shortest route passing through the cavity Ca) from the passageway 101*a* is the longest.

The die casting machine 1 has an electrical connection sensor 73 and a temperature sensor 75 which are provided in the die 101. Note that, these sensors may be provided in either of the fixed die half 103 or movable die half 105. Further, these sensors are for example provided at positions where they are exposed to or come close to the space in the die 101. Note that, these sensors may be provided in either of the concave portion or convex portion forming the space in the die 101 in the fixed die half 103 or movable die half 105. In the explanation of the present embodiment, the case where they are provided in the concave portion of the fixed die half 103 is exemplified (FIG. 8B and FIG. 8C, etc.).

The electrical connection sensor 73 outputs a signal in accordance with the conduction of current at a predetermined position in the die 101. That is, the electrical connection sensor 73 detects the conduction of current at a predetermined position in the die 101. Note that, the signal in accordance with the conduction of current may be a signal which is output only at the time when the conduction of current is detected or may be a signal having a signal level corresponding to each of conduction of current or non-conduction of current.

Specifically, the electrical connection sensor 73, for example, although not particularly shown, has a pair of electrodes which are exposed in the die 101. Further, when the semi-solidified metal injected into the die 101 contacts the pair of electrodes, the pair of electrodes are energized. Further, the electrical connection sensor 73 outputs the signal showing this when the pair of electrodes are energized.

By detection of conduction of current by the electrical connection sensor 73, it is detected that the semi-solidified metal reaches the position at which the electrical connection sensor 73 detects the conduction of current.

The position at which the electrical connection sensor 73 detects the conduction of current (exposure position of the pair of electrodes) is for example made a suitable position in the die 101 so as to be able to detect that the semi-solidified metal is substantially filled in the cavity Ca.

For example, the position at which the conduction of current is detected is the position in the overflow part 101*b*. More preferably, so as to be able to detect the conduction of current before the semi-solidified metal is completely filled in the overflow part 101*b*, the position at which the conduction of current is detected is a position separated from the end part of the overflow part 101*b* (for example an outer edge on the opposite side to the cavity Ca) toward the cavity Ca side and is for example the position nearer the cavity Ca side than the center of the volume of the overflow part 101*b*.

Further, for example, different from the illustrated example, the position at which the conduction of current is detected may be the position adjacent to the outer edge of the cavity Ca on the opposite side to the passageway 101*a* or the position having the longest route from the passageway 101*a*. Note that, the meanings of the "opposite side" and "route" referred to here are the same as those explained for the position of the overflow part 101*b*.

The temperature sensor 75 outputs a signal in accordance with the temperature at a predetermined position in the die 101. That is, the temperature sensor 75 detects the temperature at a predetermined position in the die 101. The signal in accordance with the temperature is for example a signal having a signal level changing corresponding to the change of the temperature. The temperature sensor 75 may be a contact type or noncontact type. For example, the temperature sensor 75 is a thermocouple exposed in the die 101. Other than this, the temperature sensor 75 may be for example a thermistor as well which is buried in the die 101 and is not exposed in the die 101 (in the space to which the semi-solidified metal is supplied).

When the semi-solidified metal is injected into the die 101 and the semi-solidified metal reaches the position at which the temperature sensor 75 detects the temperature, the temperature detected by the temperature sensor 75 rises. Accordingly, for example, based on the temperature detected by the temperature sensor 75, it is possible to detect that the semi-solidified metal reaches the position at which the temperature is detected. Further, after the semi-solidified metal reaches the position at which the temperature is detected, the semi-solidified metal is stripped of heat by the die 101, therefore the temperature detected by the temperature sensor 75 falls. Accordingly, for example, based on the temperature detected by the temperature sensor 75, the progress of solidification of the semi-solidified metal can be grasped.

The position at which the temperature sensor 75 detects the temperature may be set to a suitable position in the die 101.

For example, when the temperature sensor 75 is provided for the purpose of detecting that the semi-solidified metal is substantially filled in the cavity Ca, the position at which the temperature sensor 75 detects the temperature is preferably the same as the preferred position for detecting the conduction of current by the electrical connection sensor 73 as explained above. The detection position is for example a position adjacent to the outer edge on the opposite side to the passageway 101*a* in the cavity Ca or a position having the longest route from the passageway 101*a* in the cavity Ca or the position in the overflow part 101*b*. The position in the overflow part 101*b* is for example a position separated from the end part of the overflow part 101*b* toward the cavity Ca side or a position nearer the cavity Ca side than the center of volume of the overflow part 101*b*.

Further, for example, when the temperature sensor 75 is provided for the purpose of grasping the progress of solidification of the semi-solidified metal, the position at which the temperature sensor 75 detects the temperature may be a suitable position in the die 101. For example, the detection position is for example a position adjacent to the outer edge on the opposite side to the passageway 101*a* in the cavity Ca or a position having the longest route from the passageway 101*a* in the cavity Ca or is a position, opposite to the illustration, near the passageway 101*a*

(Configuration of Injection Driving Part)

Figure 3B:
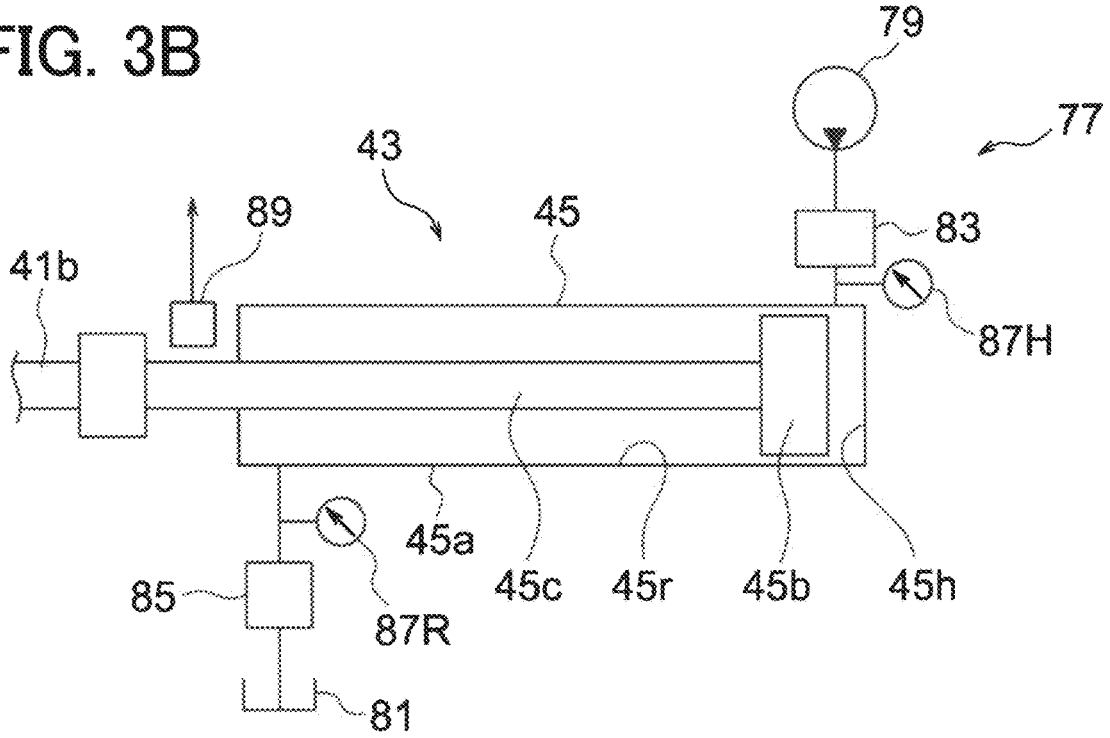

FIG. 3B is a schematic diagram showing the configuration of the injection driving part 43 for driving the plunger 41 and its peripheral devices.

The injection driving part 43 has the already explained injection cylinder 45 and a hydraulic device 77 which controls the flow of the hydraulic fluid with respect to the injection cylinder 45.

The injection cylinder 45, in addition to the above cylinder part 45*a* and piston rod 45*c*, has a piston 45*b* which is fixed to the piston rod 45*c* and can slide in the cylinder part 45*a*. The internal portion of the cylinder part 45*a* is partitioned by the piston 45*b* into a rod side chamber 45*r* on the side where the piston rod 45*c* extends outward and a head side chamber 45*h* on the opposite side to the former. Further, by the hydraulic fluid being selectively supplied to the head side chamber 45*h* and the rod side chamber 45*r*, the piston 45*b* and piston rod 45*c* advance or retract. Note that, FIG. 3B shows a so-called single barrel type injection cylinder 45, but the injection cylinder 45 may be a so-called boosting type as well.

The hydraulic apparatus 77 for example has a pump 79 capable of pumping out the hydraulic fluid, a tank 81 holding the hydraulic fluid, an inflow side valve 83 which permits or prohibits the supply of the hydraulic fluid from the pump 79 to the head side chamber 45*h*, and an outflow side valve 85 which permits and prohibits discharge of the hydraulic fluid from the rod side chamber 45*r* to the tank 81.

The piston 45*b* advances by the inflow side valve 83 being opened, the hydraulic fluid is supplied from the pump 79 to the head side chamber 45*h*, the outflow side valve 85 is opened, and the discharge of hydraulic fluid from the rod side chamber 45*r* to the tank 81 is permitted.

Further, by configuration of a meter-in circuit by using a flow rate control valve as the inflow side valve 83 and/or configuration of a meter-out circuit by using the flow rate control valve as the outflow side valve 85, the speed of advance of the piston 45*b* is controlled. Note that, the flow rate control valve is for example a flow rate control valve equipped with pressure compensation capable of adjusting the flow rate to the setting irrespective of load fluctuation or the like and is a servo valve which is used in a servo mechanism and can perform stepless adjustment of the flow rate in accordance with the signal which is input.

Note that, FIG. 3B simply shows only the principal configuration concerned with the advance of the piston 45*b* in the present embodiment. Accordingly, the hydraulic apparatus 77 includes components other than those illustrated. For example, the hydraulic apparatus 77 has a passage for supplying the hydraulic fluid to the rod side chamber 45*r* in order to retract the piston 45*b*, a valve for controlling the flow of the hydraulic fluid in the passage, and so on. Further, unlike the illustrated example, the supply of the hydraulic fluid to the head side chamber 45*h* may be carried out from an accumulator, and the hydraulic fluid discharged from the rod side chamber 45*r* may be refluxed through a so-called run-around circuit to the head side chamber 45*h*.

(Sensors of Injection Apparatus)

The injection apparatus 9 (die casting machine 1) has a head side pressure sensor 87H which detects the pressure in the head side chamber 45*h*, a rod side pressure sensor 87R which detects the pressure in the rod side chamber 45*r*, and a position sensor 89 which detects the position of the plunger 41. Note that, in the following description, sometimes the head side pressure sensor 87H and the rod side pressure sensor 87R will not be distinguished and will be simply referred to as the "pressure sensors 87".

The pressure sensor 87 outputs a signal in accordance with the pressure. The signal in accordance with the pressure is for example a signal having a signal level changing corresponding to the change of the pressure. As the pressure sensor 87, use may be made of a known suitable one such as a diaphragm type.

The pressure (injection pressure) which is given to the semi-solidified metal by the plunger 41 can be found from the detection pressures of the head side pressure sensor 87H and rod side pressure sensor 87R (two pressure sensors 87). Specifically, first, by a product of the pressure detected by the head side pressure sensor 87H and a pressure receiving area of the piston 45*b* in the head side chamber 45*h*, the force in the advancing direction given from the hydraulic fluid to the piston 45*b* is found. Further, by a product of the pressure detected by the rod side pressure sensor 87R and a pressure receiving area of the piston 45*b* in the rod side chamber 45*r*, the force in the retracting direction given from the hydraulic fluid to the piston 45*b* is found. Next, by subtracting the latter from the former, the driving force given to the plunger 41 by the piston 45*b* is found. By dividing this driving force by the press area of the plunger tip 41*a* with respect to the semi-solidified metal, the injection pressure is found.

Note that, when a meter-out circuit is not provided, the rod side pressure sensor 87R need not be provided either. That is, when the rod side chamber 45*r* is made a tank pressure in the injection, the injection pressure may be found from the detection pressure of the head side pressure sensor 87H.

The position sensor 89 for example configures a linear encoder. For example, the position sensor 89 faces a not shown scale part in a direction perpendicular to the axial direction of the scale part and generates a pulse in accordance with relative movement in the axial direction with the scale part. Further, the position sensor 89 and/or control unit 5 can identify the relative positions of the position sensor 89 and the scale part by cumulatively adding the number of generated pulses and can identify the speed by identifying the number of pulses per unit time.

Further, the position sensor 89 is provided in a fixed manner relative to the cylinder part 45*a*, and the scale part is provided in the piston rod 45*c* or a member which is fixed to the piston rod 45*c*. Accordingly, by detecting the position and/or speed of the piston rod 45*c*, the position and/or speed of the plunger 41 is indirectly detected.

Note that, the position sensor 89 need only output a pulse or may identify the position and/or speed and output a signal in accordance with that identified position and/or speed. Even in the former case, the total number of pulses differs according to the position, therefore it can be said that a signal in accordance with the position is output. Further, the number of pulses per unit time differs according to the speed, therefore it can be said that a signal in accordance with the speed is output. The signal in the latter case is for example a signal having a signal level changing in accordance with the change of the position and/or speed.

The position sensor 89 may be, other than a linear encoder as described above, for example, a laser length measuring device which is provided in a fixed manner relative to the cylinder part 45*a* and measures the distance from the piston rod 45*c* or a member which is fixed relative to the piston rod 45*c*.

(Configuration of Signal Processing System)

Figure 4:
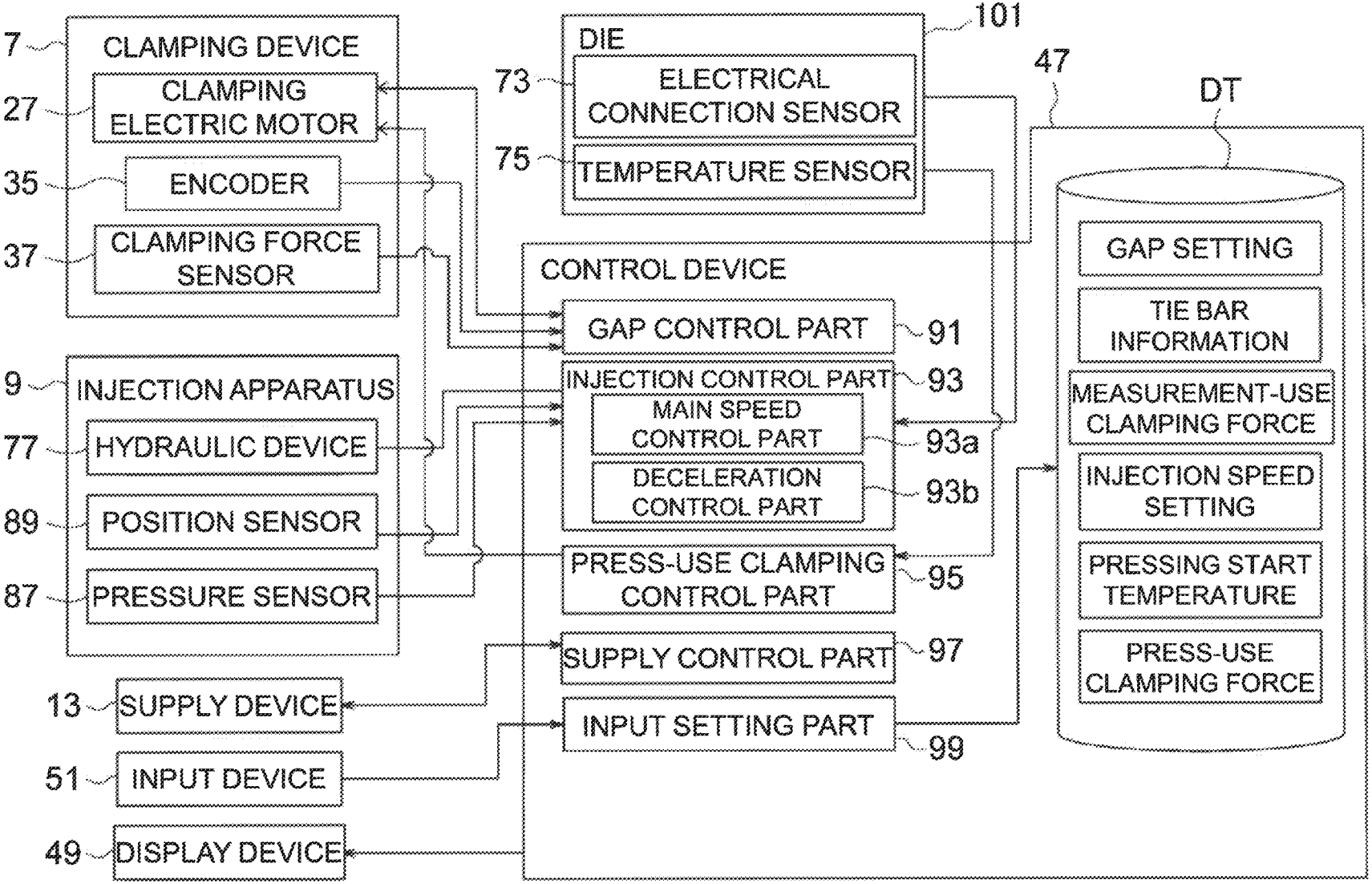
FIG. 4 is a block diagram showing the configuration according to a signal processing system in the die casting machine in FIG. 1.

FIG. 4 is a block diagram showing the configuration according to a signal processing system in the die casting machine 1.

The control device 47, for example, although not particularly shown, is configured by a computer including a CPU, RAM, ROM, and external memory unit. By the CPU executing a program stored in the ROM and external memory unit, a plurality of functional parts (91, 93, 95, 97, and 99) which perform various controls or computations are configured. Further, in the external memory unit (for temporary storage, may be a RAM), data DT containing information utilized for control is stored.

Among the plurality of functional parts constructed in the control device 47, the functional parts shown in the upper part on the drawing sheet (91, 93, and 95) are functional parts concerned with the control for the clamping device 7 and injection apparatus 9. These functional parts for example contribute to outputting of control commands to the clamping device 7 and injection apparatus 9 based on the signals from the clamping device 7 and injection apparatus 9 and the information of the data DT. Details of these functional parts will be explained in the explanation of the routine (FIG. 9) of the processing executed by the control device 47 and so on.

The supply control part 97 is the functional part for controlling the supply device 13. It controls the holding furnace 55, ladle carrying device 63, preliminary cooling unit 67, mounting apparatus 69, and vessel carrying device 71 based on various signals from these devices (for example signals from not shown temperature sensor and position sensor).

The input setting part 99 sets or updates the information held in the data DT based on the signal from the input device 51. Details of the information held in the data DT will be explained in the explanation of the routine (FIG. 9) of the processing executed by the control device 47 and so on.

(Outline of Casting Cycle)

FIG. 5A to FIG. 6C are cross-sectional views substantially showing an outline of the casting cycle executed by the die casting machine 1. The casting cycle proceeds in order from FIG. 5A to FIG. 6C.

Figure 5A:
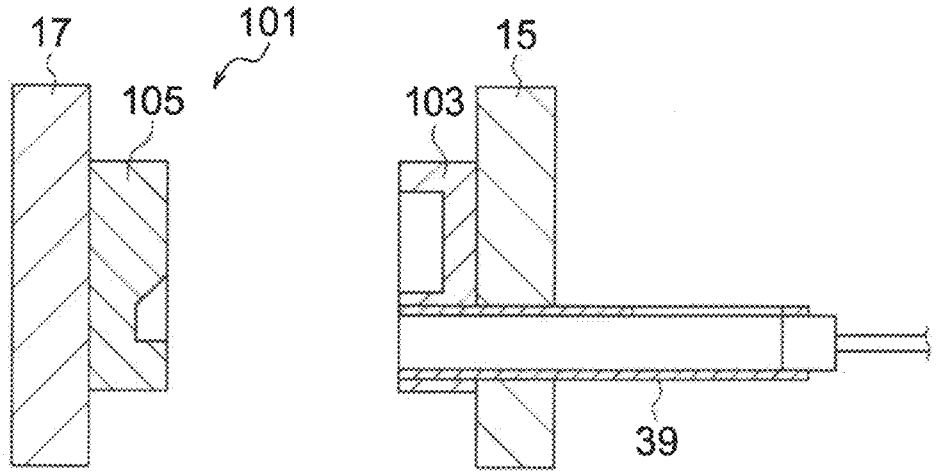
FIG. 5A, FIG. 5B and FIG. 5C are cross-sectional views substantially showing an outline of a casting cycle executed by the die casting machine in FIG. 1.

As shown in FIG. 5A, at the time of start of the casting cycle, the moving die plate 17 is arranged at the predetermined opening position which is relatively separated from the fixed die plate 15, so the die 101 is set in the opening state.

Figure 5B:
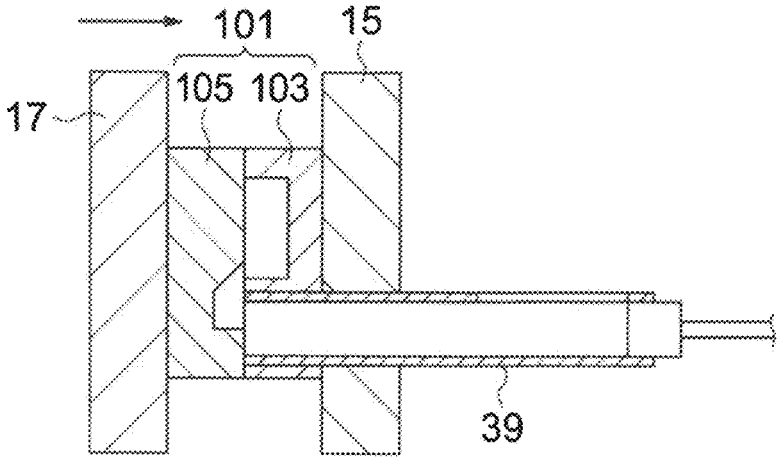

Next, as shown in FIG. 5B, the die is closed and clamped by the clamping driving part 21. This clamping is, as will be explained later, carried out for finding the thickness of the die 101 (from another viewpoint, the position of the moving die plate 17 at the time of die contact).

Figure 5C:
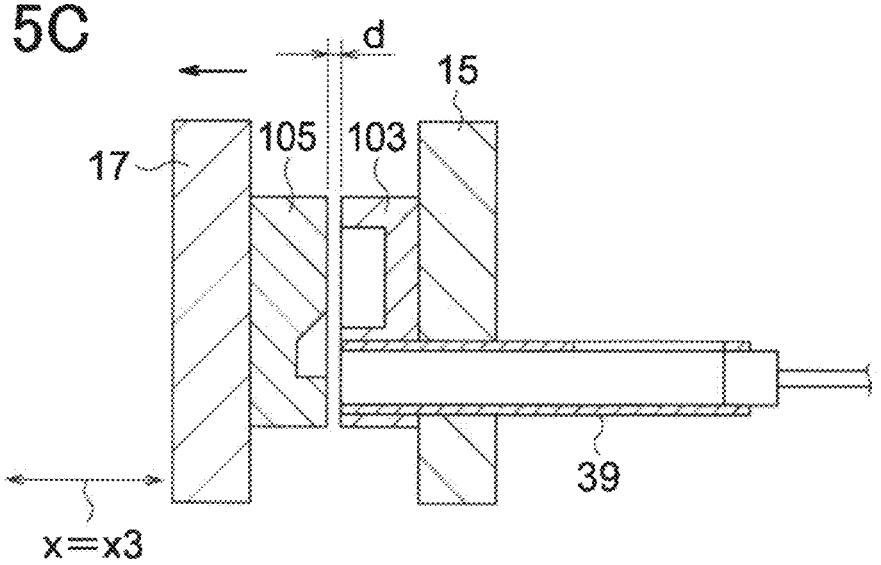

Next, as shown in FIG. 5C, the die is opened by the clamping driving part 21. At this time, the die 101 is positioned so that the mating surfaces thereof (surfaces which abut against each other in the opening/closing direction when the clamping is carried out) are separated from each other with a relatively small gap "d".

Figure 6A:
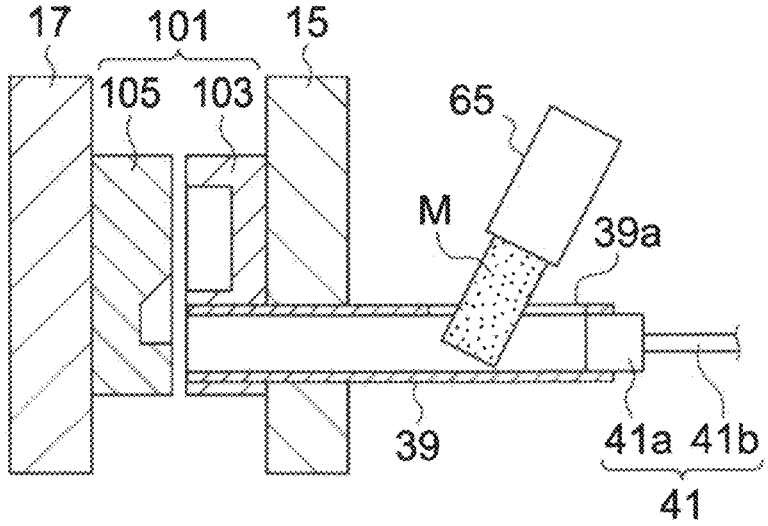
FIG. 6A, FIG. 6B and FIG. 6C are cross-sectional views showing a continuation of FIG. 5C.

Next, as shown in FIG. 6A, the semi-solidified metal M is supplied to the sleeve 39 by the supply device 13.

Figure 6B:
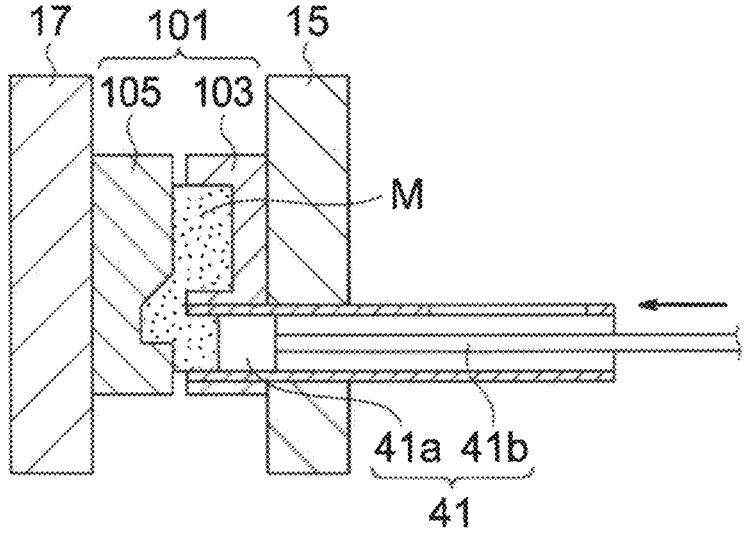

Next, as shown in FIG. 6B, the plunger 41 is driven forward by the injection driving part 43, and the semi-solidified metal M is injected to the space in the die 101. The die 101 is opened with a gap "d", but the viscosity of the semi-solidified metal M is relatively high and the gap "d" is relatively small and so on, therefore run out of the semi-solidified metal M from the mating surfaces of the die 101

(formation of burrs) is suppressed (suppression referred to here includes a case where run out does not occur).

Figure 6C:
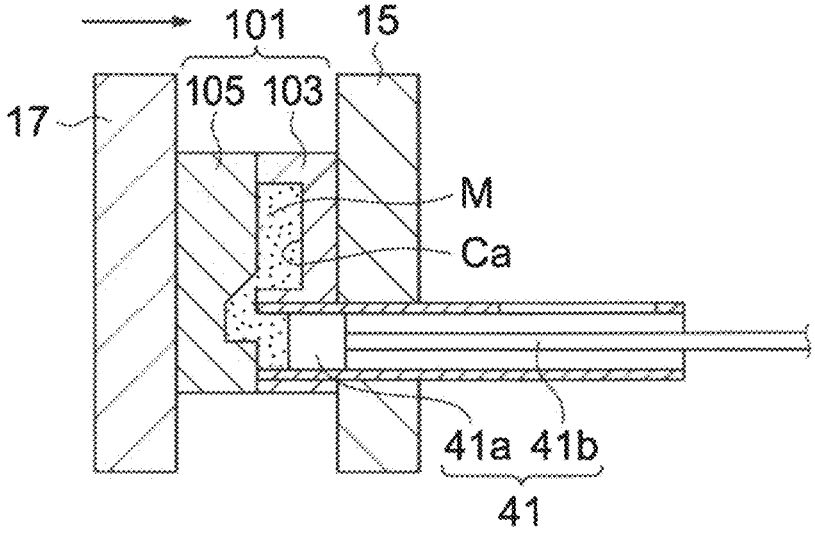

Next, as shown in FIG. 6C, the clamping is carried out by the clamping driving part 21. Due to this, the semi-solidified metal M filled in the die 101 is pressed. As a result, (a portion of) the semi-solidified metal M is cast to the shape of the cavity Ca in the die 101. Further, the primary crystals are compressed by the pressure at time of pressing and the metal structure is densified, so the quality of the product is improved.

After that, the die is opened, the product is taken out, and so on, so the casting cycle ends. Further, when the die casting machine 1 was set so that the casting cycle is repeatedly carried out, the next casting cycle is started.

In this way, one of the characteristic features of the die casting machine 1 in the present embodiment resides in that the injection is not carried out in the clamped state, but is carried out in a state where the die is opened a bit (FIG. 6B) then the semi-solidified metal is pressed by clamping (FIG. 6C).

The size of the gap "d" in FIG. 5C may be suitably set by considering various circumstances such as the clamping force and viscosity of the semi-solidified metal. For example, the gap "d" is 0.1 mm to 3.0 mm. With this size, for example, the effect of pressing (FIG. 6C) can be obtained while reducing the probability of run out of the semi-solidified metal from the cavity Ca. Further, from the viewpoint of obtaining a sufficient effect of pressing, the gap "d" is preferably 1 mm or more.

The setting of the gap "d" is held in the data DT. This setting may be set by the manufacturer of the die casting machine 1 or set through the input setting part 99 by operation by the operator with respect to the input device 51 or may be calculated by the control device 47 based on the information of shape of the die and so on.

Note that, the gap "d" is naturally relatively small compared with the distance between the mating surfaces of the die 101 in the usual opening operation (FIG. 5A). For example, the distance between the mating surfaces in the usual opening operation is at least a size large enough to take out the product from the space in the die 101 and consequently larger than the thicknesses of the product and biscuit. On the other hand, the gap "d" is smaller than the thickness of the product. Accordingly, for example, it may be judged whether the vicinity state in FIG. 5C is exhibited by whether the interval between the mating surfaces of the die 101 is smaller than the thickness of the product formed by the die 101.

When the semi-solidified metal is supplied to the sleeve 39 (FIG. 6A), unlike the liquid-state metal, the probability of the semi-solidified metal flowing to the front of the sleeve 39 (fixed die half 103) and running down from the fixed die half 103 is extremely low. Accordingly, the timing of supply of the semi-solidified metal to the sleeve 39 (FIG. 6A) may not be after the completion of the positioning in FIG. 5C, but may overlap the timing of the operation from FIG. 5A to FIG. 5C. When they are made to overlap each other, the casting cycle can be shortened.

Note, for example, when positioning etc. in FIG. 5C is carried out after the semi-solidified metal is supplied to the sleeve 39, there is the probability that the semi-solidified metal will be unnecessarily cooled in the sleeve 39. From the viewpoint of reducing such the probability, the positioning in FIG. 5C may be completed before or immediately after the completion of supply of the semi-solidified metal to the sleeve 39.

In connection with the above description, when moving the plunger 41 forward (FIG. 6B), the semi-solidified metal does not reach the space in the die 101 from the time before the start of advance or time immediately after the start of advance unlike the liquid-state metal. Therefore, the positioning in FIG. 5C may be completed after the start of advance of the plunger 41 (after the start of injection) as well. Note, from the viewpoint of making the semi-solidified metal move to the space in the die 101 in a state where the gap "d" is reliably controlled to the intended size, the plunger 41 may be advanced after the completion of the positioning in FIG. 5C.

A suitable configuration and/or operation may be adopted or employed so that at the time of injection, the gap "d" does not become larger by the pressure applied from the semi-solidified metal to the die 101. For example, in the screw mechanism 29, not a ball screw mechanism, but a sliding screw mechanism is employed or a lead angle may be made small so that the screw shaft 31 does not rotate by force to the link housing 23 side which is given to the nut 33. Further, the clamping electric motor 27 may be feedback controlled so as to stop at a constant position or may be provided with a brake. Other than this, a suitable stopper may be provided in the moving die plate 17 or clamping driving part 21 as well.

(Measurement of Die Thickness)

As explained with reference to FIG. 5B, in the present embodiment, the die thickness is measured for each casting cycle. Due to this, for example, even in a case where the die thickness changes according to a temperature change, the gap "d" can be correctly controlled in the process in FIG. 5C. The measurement method is as follows.

In the measurement of the die thickness, for example, the clamping driving part 21 is driven so as to move the moving die plate 17 to the closing direction. This driving operation is carried out from the opening state (FIG. 5A) through die contact until the clamping force detected by the clamping force sensor 37 reaches the predetermined measurement-use clamping force. At this time, in the period from the opening state to die contact, the tie bars 19 do not stretch and their length remains $L_0$. On the other hand, in the period from die contact to when the measurement-use clamping force is obtained, the tie bars 19 stretch with an elongation in accordance with the clamping force. At the time when the measurement-use clamping force is obtained, the length of the tie bars 19 becomes $L_0+\Delta L$.

Here, $\Delta L$ can be calculated from the measurement-use clamping force and the number, Young's modulus, cross-sectional area, and length $L_0$ of the tie bars 19. On the other hand, the position "x" of the moving die plate 17 (relative position relative to the end part of the tie bar 19 on the link housing 23 side) can be identified based on the detection value of the encoder 35. Accordingly, when the position "x" is equal to x2 at the time when the measurement-use clamping force is obtained, the die contact position x1 can be calculated from $x1=x2-\Delta L$. Note that, since the fixed die plate 15 is fixed, identification of the die contact position x1 corresponds to the measurement of the die thickness.

Further, a position x3 in the vicinity state in FIG. 5C is calculated from $x3=x1-d$ by using the die contact position x1 and predetermined gap "d".

Note that, when the clamping force sensor 37 includes a strain gauge, it is also possible to calculate $\Delta L$ from the strain and length $L_0$. Accordingly, for example, in the case of calculation based on the clamping force and the information of the tie bars, not only use of the value of the clamping force itself, but also use of a value correlated with the clamping force (for example, strain) are included. This is true also for other physical quantities (relative position "x" etc.)

In order to perform the measurement as described above, the control device 47 for example performs feedback control for the clamping electric motor 27 so that the clamping force detected by the clamping force sensor 37 converges to the setting of the measurement-use clamping force held in the data DT. The setting of the measurement-use clamping force held in the data DT is for example set by the manufacturer of the die casting machine 1. Note, the setting of the measurement-use clamping force may be set by the input setting part 99 based on a signal from the input device 51 or the like.

The concrete value of the measurement-use clamping force may be suitably set. For example, when the magnitude of the clamping force representing the size of the die casting machine is 100%, the value may be set to 100% or may be smaller than this. Further, the measurement-use clamping force may be the same as the clamping force for pressing in FIG. 6C or different from the latter.

(Change of Physical Quantity Concerned with Injection and Pressing in Comparative Example)

Figure 7A:
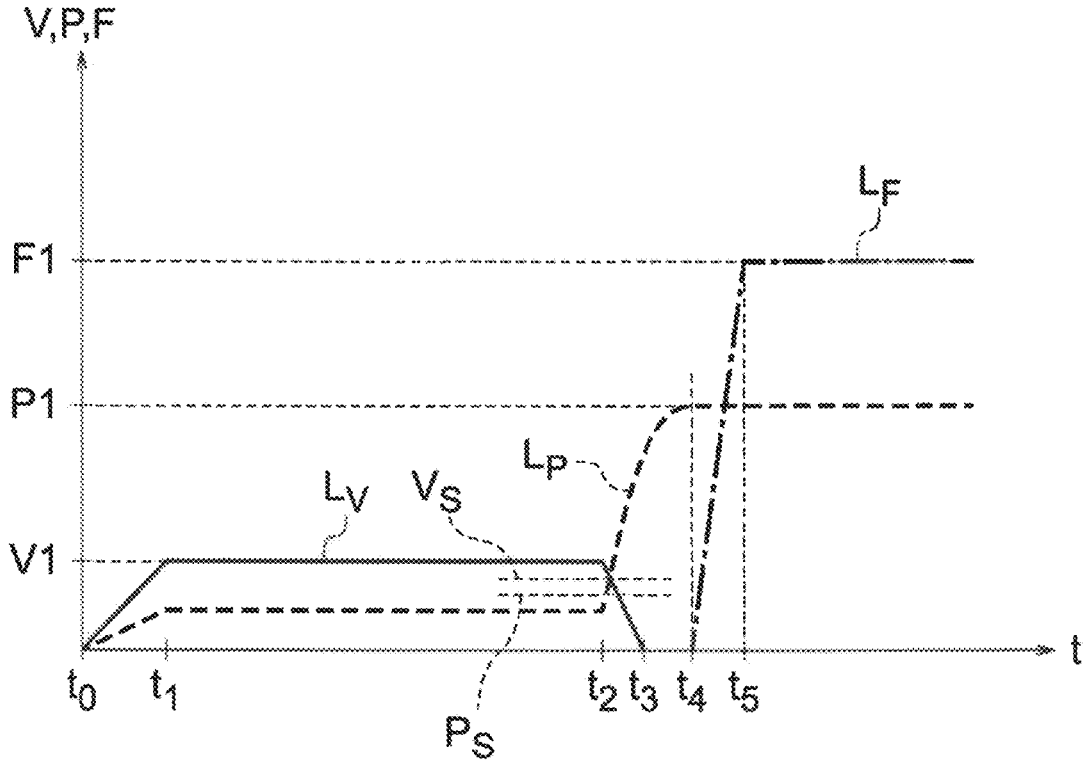
FIG. 7A and FIG. 7B are diagrams showing the changes along time of the injection speed, injection pressure, and clamping force in the comparative examples and the embodiment.

FIG. 7A is a diagram showing the changes with time of the injection speed, injection pressure, and clamping force in the injection (FIG. 6B) and pressing (FIG. 6C) according to a comparative example.

In the same diagram, an abscissa indicates the time "t", and an ordinate indicates the injection speed V (advance speed of plunger 41), injection pressure P (pressure which is given to the semi-solidified metal by the plunger 41), or clamping force F (force of fastening the die 101). Lines $L_V$, $L_P$, and $L_F$ indicate changes of the injection speed V, injection pressure P, and clamping force F along with an elapse of time "t".

The injection speed V is for example made constant over substantially the entire period where the semi-solidified metal moves to the space in the die 101. That is, in the injection of the liquid-state metal, low speed injection for reducing entrainment of air by the liquid-state metal and high speed injection for filling without delay the solidification of the liquid-state metal are carried out in many cases. However, in the injection of the semi-solidified metal in the comparative example (and present embodiment), such a speed change is not carried out. Note, a suitable speed change may be carried out as well.

Specifically, the injection speed relatively smoothly reaches the relatively low constant speed V1 (t1) from the time of start (t0) of the injection process. The speed gradient (degree of acceleration) at this time may be for example set to the maximum speed gradient within a range where an excessive load is not generated in the injection apparatus 9. Further, the constant speed V1 is maintained for a relatively long time. Most of the semi-solidified metal moves to the space in the die 101 during this time. After that, the injection speed begins to fall due to the force which is received by the plunger 41 from the semi-solidified metal which is substantially filled in the die 101 (t2). Further, the injection speed becomes (substantially) 0 by the completion of filling of the semi-solidified metal (t3). That is, injection in a narrow sense ends.

The injection pressure P rises along with the start of advance (t0) of the plunger 41 and continues with a relatively low pressure at the time when the plunger 41 is advancing at a constant speed (t1 to t2). After that, when the semi-solidified metal is filled in the die 101 to a certain extent (t2), the resistance of the semi-solidified metal to the filling becomes larger, so the injection pressure relatively rapidly rises. Further, due to the boost operation which is started during the period when the plunger 41 is decelerating (t2 to t3), the injection pressure becomes the maximum (final pressure P1) after the plunger 41 substantially stops (t3), then is maintained at a constant value.

The clamping force F indicated by the line $L_F$ in FIG. 7A shows both of the force which is added to the die 101 along with the reduction of the gap "d" and the force which is added to the die 101 by die contact after that. In the example in the same diagram, when the injection pressure P reaches the final pressure P1 (t4: from another viewpoint, if the injection pressure converges to a constant magnitude), the moving die plate 17 starts to move to the fixed die plate 15 side by the driving force of the clamping electric motor 27 (the reduction of the gap "d" is started). Due to this, the clamping force begins to rise, the die contact is carried out at a suitable point of time in the period from the point of time t4 to the point of time t5, and the clamping force F reaches the press-use clamping force F1 which is set in advance. After that, the clamping force F is maintained at the press-use clamping force F1.

(Change of Physical Quantity Concerned with Injection and Pressing in Example)

Figure 7B:
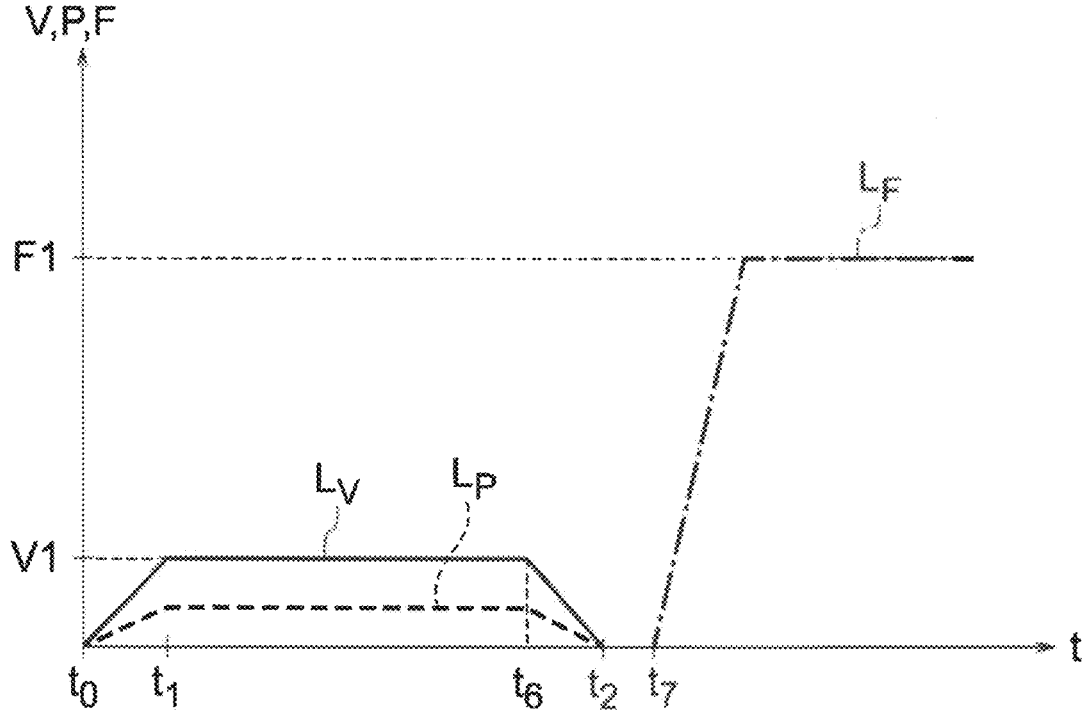

FIG. 7B is a diagram showing the changes with time of the injection speed, injection pressure, and clamping force in the injection (FIG. 6B) and pressing (FIG. 6C) according to a working example and corresponds to FIG. 7A.

In the comparative example shown in FIG. 7A, the injection speed V is decelerated by the force which is received by the plunger 41 from the semi-solidified metal which is substantially filled in the space in the die 101 and reaches 0 (t2 to t3). At this time, the injection pressure P rises. In such an aspect, for example, if the gap "d" in the die 101 is large, the semi-solidified metal runs out from the mating surfaces of the die 101 by the raised injection pressure P resulting in formation of burrs. On the other hand, if the gap "d" is made small, the effect of densifying the structure of the semi-solidified metal by pressing falls.

Therefore, in the present embodiment, as shown in FIG. 7B, at the time when the semi-solidified metal is substantially filled in the die 101 (t2) or before that time, the plunger 41 is decelerated by the injection driving part 43. Further, a boost operation is not carried out after the plunger 41 substantially stops. From another viewpoint, the deceleration control for the plunger 41 is carried out and the injection is ended (the plunger 41 is (substantially) stopped). Due to this, a rise of the injection pressure P is suppressed (a case where it does not rise is included). Consequently, even if the gap "d" is made large to obtain a sufficient pressing effect, formation of burrs can be suppressed. For example, increase of the gap "d" to 1 mm or more is facilitated.

Note that, for example, consider a case where a control signal gradually throttling the degree of opening of the inflow side valve 83 and/or outflow side valve 85 is not output from the injection control part 93, but a control signal aimed at only closing these valves is output. For example, this is a case where the signal level of the control signal does not gradually change from a signal level corresponding to the opening position to a signal level corresponding to the closing position, but is instantaneously switched from the signal level corresponding to the opening position to the signal level corresponding to the closing position. Even in this case, deceleration occurs as result, then stopping occurs after that. Accordingly, in the explanation of the present embodiment, in the case of control for decelerating the plunger 41 or the like, unless otherwise noted, not only control for the purpose of only deceleration or deceleration and suspension, but also control for the purpose of stopping the plunger 41 are included. Further, in the case of the control for stopping the plunger 41, unless otherwise noted, control for stopping the plunger after deceleration control in the narrow sense such as gradually reducing the degree of opening of the valve and finally closing the valve is included. In the case of control for deceleration or the like, a case where a control signal for deceleration is not output and deceleration occurs due to the force received by the plunger 41 from the semi-solidified metal substantially filled in the die 101 is not included.

Except for deceleration control being carried out and a boost operation not being carried out, the operation in the embodiment may be the same as the operation in the comparative example. The explanation in the comparative example described above may be applied as it is to the present embodiment. For example, the injection speed V may be set constant over substantially the entire period of movement of the semi-solidified metal to the space in the die 101.

The timing of start of deceleration may be, different from the illustrated example, a point of time (near t2) at which the semi-solidified metal is substantially filled in the die 101 or may be a point of time (t6) before the above point time as in the illustrated example. It may be suitably set in accordance with the shape of the individual die 101 so that the semi-solidified metal fills the entire cavity Ca at the time of completion of pressing and yet so that the rise of the injection pressure is suitably suppressed.

The plunger 41 may substantially stop by the deceleration by the injection driving part 43, and no rise of the injection pressure may occur as in the illustrated example. Further, different from the illustrated example, the plunger may stop by the force received from the semi-solidified metal while being decelerated by the injection driving part 43. Even in the latter case, by deceleration control being carried out, rise of the injection pressure is suppressed compared with the case where the deceleration control is not carried out.

The speed gradient at the time of deceleration may be suitably set. This speed gradient, as understood from the above explanation, may be generated as a result of control delay or may be intentionally controlled. Further, when the speed gradient is controlled, the control may be feedback control or may be open control.

(Outline of Control of Injection and Pressing)

Figure 8A:
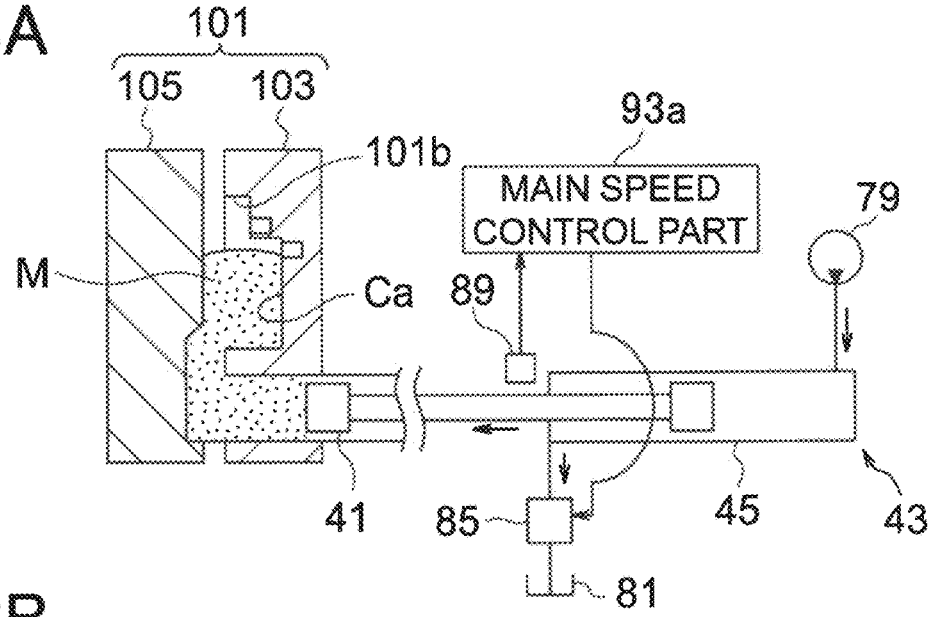
FIG. 8A, FIG. 8B and FIG. 8C are schematic diagrams showing an outline of injection and pressing control.
Figure 8B:
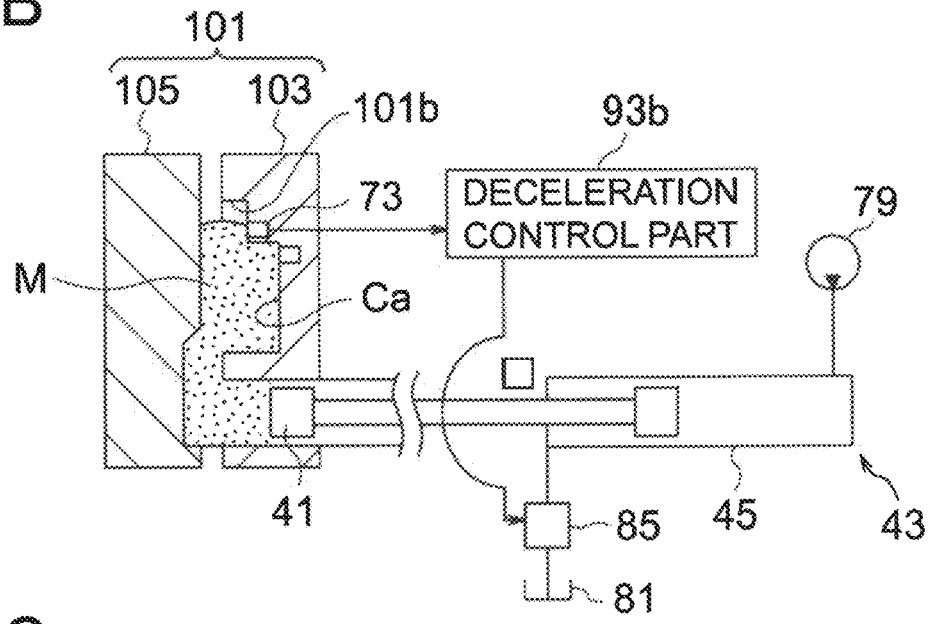
Figure 8C:
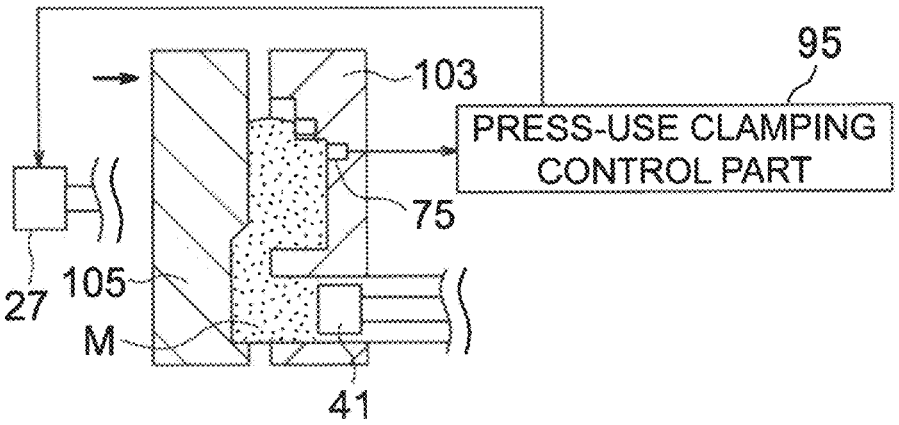

FIG. 8A to FIG. 8C are schematic diagrams showing an outline of the control of injection and pressing.

FIG. 8A schematically shows the control at the time when the plunger 41 is advanced and the semi-solidified metal is filled in the die 101 (t0 to t6 in FIG. 7B). Note that, the speed at this time is, as already explained, for example, basically the constant speed V1 which is relatively low.

The injection control part 93 (main speed control part 93*a*) for example refers to the setting value (target value) of the injection speed held in the data DT and performs speed feedback control for the injection driving part 43 so that the speed of the plunger 41 converges to the setting value based on the detection value of the position sensor 89. Note that, this speed feedback control may be control where the deviation of the speed itself is found or may be control where speed feedback control is substantially carried out by finding the deviation between the target position moment by moment (for each elapsed time) which is found from the setting value of the speed and the detected position and performing the position feedback control moment by moment. The speed of the injection driving part 43, as already explained, is controlled according to the degree of opening of the inflow side valve 83 (not shown here) and/or outflow side valve 85.

The setting value of the injection speed of the data DT is for example set by the input setting part 99 based on the signal from the input device 51. In other words, it is set by the operator. Note that, the setting value of the injection speed or a range in which the setting value can be set may be set by the manufacturer of the die casting machine 1, or the control device 47 may set the setting value of the injection speed based on the information of the shape of the die etc.

The concrete value of the constant speed V1 may be suitably set. For example, the constant speed V1 may be equal to the speed of low speed injection in the injection of the liquid-state metal and may be 1 m/s or less and further 0.2 m/s or less (for example about 0.1 m/s). This is because, in the present embodiment, the semi-solidified metal is finally shaped by the clamping force, therefore the necessity of filling the semi-solidified metal in an early stage and giving a high pressure to the semi-solidified metal by the plunger 41 in an early stage is low.

FIG. 8B schematically shows the control at the time when the deceleration of the plunger 41 is started (t6 in FIG. 7B).

The injection control part 93 (deceleration control part 93*b*), for example, when detecting the conduction of current based on the signal from the electrical connection sensor 73, controls the injection driving part 43 so as to decelerate the plunger 41. As already explained, the electrical connection sensor 73 is for example positioned nearer the cavity Ca than the end part of the overflow part 101*b*, therefore the conduction of current is detected when the semi-solidified metal is substantially filled in the cavity Ca but before the semi-solidified metal is filled in the entire space in the die 101. Accordingly, deceleration is started before the point of time t2 at which the injection pressure rises.

The control for decelerating the plunger 41 is the control for reducing (closing) the degree of opening of the inflow side valve 83 (not shown here) and/or outflow side valve 85. For example, the injection control part 93 outputs a control signal in order to close the inflow side valve 83 and/or outflow side valve 85. The deceleration until the suspension for example occurs due to the control delay in these valves and injection cylinder 45 or the like. Naturally, the control signal may be output so that the deceleration does not occur due to the control delay, but occurs with a desired speed gradient. If the inflow side valve 83 and/or outflow side valve 85 is closed, basically, pressure is not given to the plunger 41 from the injection cylinder 45, and the injection pressure substantially becomes 0 (see also FIG. 7B).

Note that, naturally an unavoidable control delay may occur in the period from the detection of conduction of current by the electrical connection sensor 73 to when the deceleration is started. Further, as a result of performing a trial injection after attaching the electrical connection sensor 73 to the die 101, deviation between the detection point of time of conduction of current and preferred point of time of start of deceleration is considered. In order to finely adjust the starting point of time of deceleration in such case, some time lag (for example not more than 0.1 second though according to the injection speed or the like) may be intentionally set for the period from the detection of conduction of current to the output of the control signal for deceleration. In the present embodiment, in the case where the control for decelerating the plunger 41 is started (at the time) when detecting the conduction of current, the case where there is a time lag for fine adjustment is included. That is, the starting point of time of control only have to be based on the point of time of detection. This is true also in various modifications in place of the detection of conduction of current as will be explained later.

FIG. 8C schematically shows the control at the time when pressing is started (t7 in FIG. 7B).

The press-use clamping control part 95 for example judges whether the temperature of the semi-solidified metal (from another viewpoint, the inside of the die 101 or the inside of the cavity Ca) falls to a predetermined pressing start temperature based on the temperature detected by the temperature sensor 75. More specifically, for example, the press-use clamping control part 95 repeatedly judges whether the temperature in the die 101 exceeds the pressing start temperature conditional on the electrical connection sensor 73 detecting conduction of current or after the start of injection. On condition it is judged yes in that judgment, the press-use clamping control part 95 judges whether the temperature in the die 101 is the pressing start temperature or less. Further, when judging (detecting) that the temperature falls to the pressing start temperature, the press-use clamping control part 95 controls the clamping device 7 (clamping electric motor 27) so as to start the clamping for pressing.

By starting pressing in this way, for example, pressing is carried out after the viscosity of the semi-solidified metal becomes high to a certain extent, therefore escape of the pressure of pressing to the overflow part can be suppressed.

The pressing start temperature is held in the data DT and may be set by the manufacturer of the die casting machine 1 or may be set by the input setting part 99 by operation of the input device 51 by the operator or may be set by the control device 47 based on the information of the material of the semi-solidified metal etc. The pressing start temperature may be suitably set based on trial casting or the like. As an example, the pressing start temperature may be made the temperature at the time when the solid phase rate of the semi-solidified metal becomes a so-called flow limit solid phase rate or a temperature lower than that.

Further, the temperature used for the judgment of whether the pressing start temperature is reached may be the detection temperature by the temperature sensor 75 as it is or may be a temperature after performing predetermined correction on the detection temperature. The correction is for example one converting the temperature at the position of the temperature sensor 75 to the temperature of the center part of the semi-solidified metal. However, comparison of the corrected detection temperature with the pressing start temperature can be grasped as corresponding to comparison between the raw detection temperature with the corrected pressing start temperature in the narrow sense. In the end, it is none other than comparison between the detection temperature and a pressing start temperature in a broad sense.

A concrete value of the press-use clamping force F1 may be suitably set. For example, in general, the size of the die casting machine is represented by the clamping force. This clamping force is usually used in the casting cycle. The magnitude of this clamping force may be defined as the press-use clamping force F1. Further, when the magnitude of the clamping force representing the size of the die casting machine is 100%, in accordance with the quality requested from the product, the shape of the cavity Ca, solid phase rate of the semi-solidified metal, and so on, the press-use clamping force F1 may be suitably set within a range less than 100% or a range exceeding 100%. Further, the aspect of change of the clamping force in the process where the clamping force rises may be suitably set.

The setting of the press-use clamping force is stored in the data DT. This setting may be set by the manufacturer of the die casting machine 1 or set by the input setting part 99 in accordance with operation by the operator of the input device 51 or may be set by the control device 47 based on the information of the material of the semi-solidified metal and so on.

During the period where the pressing is carried out, the injection control part 93 may suitably control the injection apparatus 9 so that the plunger 41 does not retract by the pressure received by the plunger 41 from the semi-solidified metal. For example, the injection control part 93 may control a not shown valve so as to prohibit the discharge of the hydraulic fluid from the head side chamber 45*h*. Further, for example, the force in the advance direction may be added to the plunger 41 by the injection driving part 43 as well. Note that, where a force in the advance direction is added to the plunger 41, only suppression of the retraction of the plunger 41 may be occur or the force of the plunger 41 may be given to the semi-solidified metal in addition to the pressing force. Further, when force in the advance direction is added to the plunger 41, after the deceleration in the end stage of injection, the injection driving part 43 may be again driven after the driving operation of the injection driving part 43 is once stopped or the driving operation of the injection driving part 43 may be continued even when the deceleration is being carried out in the end stage of injection.

(One Example of Routine of Processing by Control Device)

Figure 9:
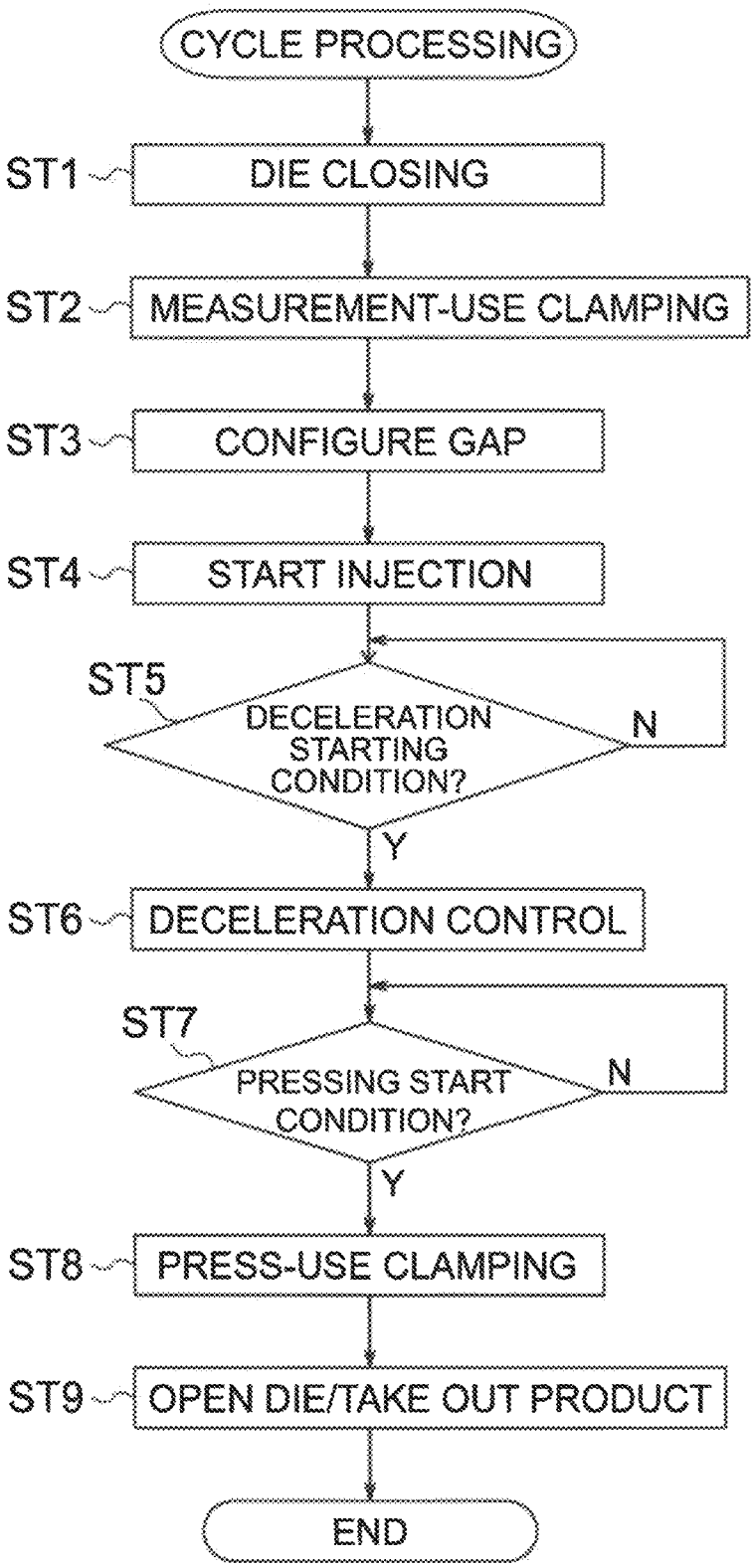
FIG. 9 is a flow chart showing an example of the routine of cycle processing executed by the control device in the die casting machine in FIG. 1.

FIG. 9 is a flow chart showing an example of the routine of the cycle processing executed by the control device 47 in order to realize the casting cycle explained with reference to FIG. 5A to FIG. 8. This processing is for example repeatedly executed using as the trigger the operation of the start of cycle with respect to the input device 51.

At step ST1, the control device 47 controls the clamping device 7 so as to perform closing (FIG. 5A and FIG. 5B). Specifically, for example, the control device 47 outputs a control command to the clamping electric motor 27 so as to make the clamping electric motor 27 rotate in a rotation direction which corresponds to the movement of die plate 17 toward the closing direction. The speed at this time is for example suitably feedback controlled based on the detection value of the encoder 35.

At step ST2, the control device 47 performs clamping (FIG. 5B) for measuring the die thickness (die contact position). Specifically, the control device 47, following step ST1, outputs a control command to the clamping electric motor 27 so as to make the clamping electric motor 27 rotate in a rotation direction where the moving die plate 17 moves to the closing direction and makes the clamping electric motor 27 rotate until the measurement-use clamping force stored in the data DT is obtained. Further, the control device 47 calculates ΔL based on the measurement-use clamping force and the tie bar information stored in the data DT (number, cross-sectional area, Young's Modulus, and length $L_0$) and identifies the die contact position.

Note that, the correct die contact position reflecting the thermal expansion etc. of the die 101 is specified at this step ST2. However, at step ST1 etc., use may be made of a standard die contact position which is provisionally input or measured and does not have such correctness. For example, at step ST1, at the time when the moving die plate 17 approaches the standard die contact position up to the predetermined distance, the moving die plate 17 may be decelerated so as to mitigate the impact of die contact. Further, at the time when the moving die plate 17 approaches the standard die contact position up to the predetermined distance, the control may be switched from speed control (step ST1) to torque control (step ST2).

At step ST3, the control device 47 (gap control part 91) controls the clamping device 7 (FIG. 5C) so that the die 101 is opened with the gap "d" using the die contact position identified at step ST2 as the reference. Specifically, for example, the gap control part 91, as explained with reference to FIG. 5B and FIG. 5C, identifies the position x3 corresponding to the gap "d" (gap setting value) stored in the data DT and performs feedback control for the position of the moving die plate 17 based on the detection value of the encoder 35 so that the moving die plate 17 is positioned at that specified position.

At step ST4, the control device 47 (supply control part 97 and injection control part 93) controls the supply device 13 and injection apparatus 9 (FIG. 6A and FIG. 6B) so that the injection of the semi-solidified metal is started. Specifically, the supply control part 97 controls the supply device 13 so as to supply the semi-solidified metal which is manufactured and conveyed parallel to steps ST1 to ST3 to the sleeve 39. Further, the injection control part 93 controls the injection driving part 43 so as to move the plunger 41 forward. The control for the injection speed according to the main speed control part 93*a* in the injection control part 93 at this time is as already explained. In FIG. 9, as a matter of convenience, step ST4 is shown after step ST3, but the timings of the two may suitably overlap each other as already explained.

At step ST5, the control device 47 (deceleration control part 93*b*) judges whether the signal indicating the detection of conduction of current is received from the electrical connection sensor 73 as explained with reference to FIG. 8B. That is, the control device 47 judges whether the condition of starting the deceleration of the plunger 41 is satisfied. Further, the control device 47 stands by when judged no and proceeds to step ST6 when judged yes.

At step ST6, the control device 47 (deceleration control part 93*b*) controls the injection driving part 43 so as to perform the deceleration of the plunger 41. This deceleration control may be, as already explained, one that instructs only deceleration in a narrow sense (not including stopping), one that instructs only stopping to cause deceleration as the result, or one that instructs deceleration and stopping in the narrow sense.

At step ST7, the control device 47 (press-use clamping control part 95), as explained with reference to FIG. 8C, judges whether the temperature of the semi-solidified metal falls to the pressing start temperature stored in the data DT based on the signal from the temperature sensor 75. That is, the control device 47 judges whether the pressing starting condition is satisfied. Further, the control device 47 stands by when judged no and proceeds to step ST8 when judged yes.

At step ST8, the control device 47 (press-use clamping control part 95) controls the clamping device 7 (FIG. 6C) so as to perform the clamping for pressing. Specifically, the press-use clamping control part 95 outputs the control command to the clamping electric motor 27 so as to make the clamping electric motor 27 rotate in a rotation direction that moves the moving die plate 17 to the closing direction and operates the clamping electric motor 27 until the clamping force detected by the clamping force sensor 37 reaches the press-use clamping force stored in the data DT. Note that, the press-use clamping control part 95, for example, may perform feedback control based on the detection value of the clamping force sensor 37 so that the clamping force converges to the press-use clamping force as well.

At step ST9, the control device 47 judges whether the semi-solidified metal is solidified based on the elapsed time or the like and controls the clamping device 7 so as to open the die and controls the ejection device 11 so as to take out the product from the die 101 when judging solidification. Further, the control device 47 ends the cycle processing (starts the next cycle processing). Note that, although not particularly shown, other than this, a suitable step may be inserted, for example washing of the die 101 or coating of a releasing agent is carried out at a suitable timing.

As described above, in the present embodiment, the die casting machine 1 has the clamping device 7 for opening and closing and clamping the pair of die halves 101, the injection apparatus 9 which performs injection to the pair of die halves 101 by moving the plunger 41 forward in the sleeve 39 communicated with the space between the pair of die halves 101, and the control device 47 which controls the clamping device 7 and injection apparatus 9. Further, the control device 47 has the injection control part 93 and press-use clamping control part 95. The injection control part 93 controls the injection apparatus 9 so as to start the injection in a state where the pair of die halves 101 face each other through a gap (for example vicinity state where they face each other with the gap "d") (FIG. 6B). The press-use clamping control part 95 controls the clamping device so that die contact and clamping are carried out after the start of injection (FIG. 6C). Further, the injection control part 93 performs the control for decelerating the plunger 41 before the plunger 41 stops (according to the control and/or force from the semi-solidified metal).

From another viewpoint, in the present embodiment, the method for casting the solid-liquid coexisting metal (for example semi-solidified metal) has the injection step (ST4) and press-use clamping step (ST8). The injection step (ST4) controls the injection driving part 43 so as to extrude, by the plunger 41, the solid-liquid coexisting metal in the sleeve 39 communicated with the pair of die halves 101 to the space between the pair of die halves 101 facing each other through a gap (FIG. 6B). The press-use clamping step (ST8) performs the die contact and clamping of the pair of die halves 101 between which the solid-liquid coexisting metal is interposed (FIG. 6C). Further, in the injection step, control for decelerating the plunger 41 is carried out before the plunger 41 stops.

Accordingly, by pressing by the die 101, a relatively high pressure can be evenly given to the solid-liquid coexisting metal. As a result, the primary crystals of the solid-liquid coexisting metal are compressed and the structure of the metal is densified, therefore the quality of the product is improved. In addition, the supply of the solid-liquid coexisting metal to the space in the die 101 is carried out from the sleeve 39 to the die 101 by the extrusion by the plunger 41, therefore the configuration of the die casting machine for casting the liquid-state metal can be utilized. As a result, for example, the versatility of the entire apparatus or parts is improved, and consequently the costs can be reduced.

Further, control for decelerating the plunger 41 is carried out to end the injection, therefore the probability of the semi-solidified metal which was substantially filled in the die 101 and no longer has any place to go being pushed by the plunger 41 and therefore a relatively high pressure being given to the semi-solidified metal is reduced. As a result, formation of burrs is suppressed. From another viewpoint, the gap "d" can be made larger.

Further, in the present embodiment, the injection control part 93, as the control for decelerating the plunger 41, performs control for stopping the plunger 41 and ends the injection. Accordingly, a rise of pressure of the semi-solidified metal can be more reliably suppressed.

Further, in the present embodiment, the die casting machine 1 further has the electrical connection sensor 73 which outputs a signal in accordance with the conduction of current at a predetermined position in the die 101. The injection control part 93 starts the control for decelerating the plunger 41 when detecting the conduction of current based on the signal from the electrical connection sensor 73.

Accordingly, the position of the semi-solidified metal can be correctly grasped and the deceleration control can be reliably started at the time of filling of the semi-solidified metal or before filling.

Further, in the present embodiment, the die 101 forms the cavity Ca (product part) and overflow part 101*b* inside it. The position at which conduction of current is detected is a position in the overflow part 101*b* that is separated from the end part of the overflow part 101*b* to the cavity Ca side.

Accordingly, the deceleration can be started at the time when the semi-solidified metal is substantially filled in the cavity Ca, but the entire internal space in the die 101 is not completely filled with the semi-solidified metal. As a result, for example, the probability of production of a defective product because the semi-solidified metal is not sufficiently filled in the cavity Ca can be reduced. Further, the pressure applied from the plunger 41 to the semi-solidified metal can be made to escape to the overflow part 101*b*, therefore the probability of formation of burrs can also be reduced by this.

Further, in the present embodiment, the die casting machine 1 further has the temperature sensor 75 which outputs a signal in accordance with the temperature in the cavity Ca (product part). The press-use clamping control part 95 starts the control for die contact and clamping for press use when detecting that the temperature in the cavity Ca falls to a predetermined pressing start temperature based on the signal from the temperature sensor 75.

Accordingly, as already explained, the pressing operation will be carried out after the viscosity of the semi-solidified metal becomes high to a certain extent, therefore escape of the pressure of the pressing operation to the overflow part 101*b* can be suppressed. Due to this, for example, the overflow part 101*b* can be made thicker (opening cross-section can be made larger). As a result, it is made easier to provide the electrical connection sensor 73 at a suitable position and make the pressure applied from the plunger 41 to the semi-solidified metal escape.

(Modification of Deceleration Starting Condition)

In the embodiment described above, as explained with reference to FIG. 8B, the starting condition of deceleration control (step ST5) was made the detection of conduction of current by the electrical connection sensor 73. However, various starting conditions for deceleration control are possible other than this. In the following description, some examples will be shown.

First Modification

Figure 10A:
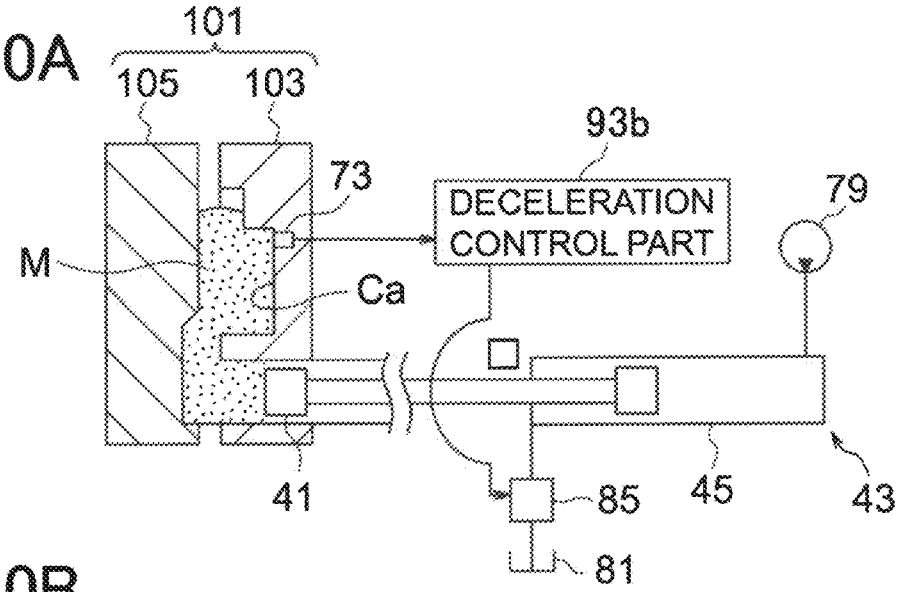
FIG. 10A, FIG. 10B and FIG. 10C are schematic diagrams showing controls when starting the deceleration of the plunger in first to third modifications.

FIG. 10A is a diagram corresponding to FIG. 8B according to a first modification and schematically shows the control when starting the deceleration of the plunger 41.

As explained also in the explanation of the embodiment, when the semi-solidified metal reaches the temperature sensor 75, the detection temperature of the temperature sensor 75 rises. Therefore, in the first modification, when detecting that the temperature in the die 101 has risen up to the predetermined deceleration start temperature based on the signal from the temperature sensor 75, the injection control part 93 controls the injection control part 43 so as to decelerate the plunger 41. More specifically, the injection control part 93 for example repeatedly judges whether the temperature in the die 101 is the predetermined deceleration start temperature or more after the start of injection and starts the deceleration control when judging yes.

The deceleration start temperature is stored in the data DT and is referred to by the injection control part 93. Further, the deceleration start temperature may be set by the manufacturer of the die casting machine 1 or set by the input setting part 99 by operation by the operator of the input device 51 or may be set by the control device 47 based on suitable information. Further, the deceleration start temperature may be suitably set in accordance with the temperature etc. of the semi-solidified metal which is supplied to the sleeve 39.

Note that, the preferred position of the temperature sensor 75 when using the temperature sensor 75 in this way is as already explained. Further, the configuration and operation in the first modification may be the same as those in the embodiment except that the electrical connection sensor 73 does not have to be provided and the starting condition of deceleration control is the temperature.

Also according to the first modification, in the same way as the embodiment, the position of the semi-solidified metal can be correctly grasped, therefore the deceleration control can be reliably started at the time of filling the semi-solidified metal or before that.

Further, in the first modification, the temperature sensor 75 used for the judgment of whether the starting condition of deceleration control is satisfied is also used in the judgment of whether the pressing starting condition is satisfied (FIG. 8C and step ST7). Accordingly, the configuration is simpler than that in the embodiment.

Second Modification

Figure 10B:
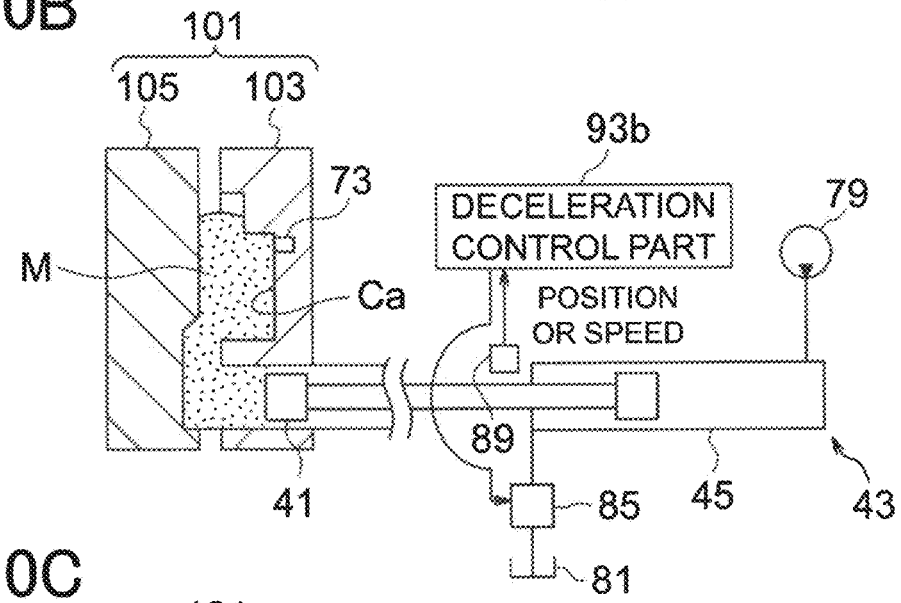

FIG. 10B is a diagram corresponding to FIG. 8B according to a second modification and schematically shows the control when starting the deceleration of the plunger 41.

The position of the plunger 41 and the degree of filling of the semi-solidified metal in the die 101 naturally are correlated. Therefore, in the second modification, the injection control part 93 controls the injection driving part 43 so as to decelerate the plunger 41 when it detects that the plunger 41 reaches the predetermined deceleration start position based on the signal from the position sensor 89. Note that, the configuration and operation in the second modification may be the same as those in the embodiment except that the electrical connection sensor 73 does not have to be provided and the starting condition of deceleration control is the position of the plunger 41.

The deceleration start position is stored in the data DT and referred to by the injection control part 93. Further, the deceleration start position may be for example set by the input setting part 99 by operation by the operator of the input device 51. Alternatively, a position a predetermined amount or ratio in front of the position of the plunger 41 at the time when the semi-solidified metal is substantially filled in the die 101 (or in the cavity Ca), specified from the information (for example information of biscuit thickness) concerning the casting conditions input through the input device 51, may be automatically set by the control device 47.

The speed change with respect to the position of the plunger 41 is also set in the usual die casting machine which does not perform pressing after injection. The second modification may be realized by utilizing the function provided in such die casting machine as well.

Note that, even when excluding pressing carried out after the injection, the second modification differs from the speed control in the usual die casting machine for example in the following point. High speed injection is carried out after low speed injection in a usual die casting machine, therefore deceleration is not carried out after injection at a relatively low speed. In a usual die casting machine, boosting is carried out after injection in the narrow sense (low speed injection and high speed injection etc.), therefore deceleration control that stops the plunger 41 is not carried out. In a case where speed feedback control of the plunger 41 is substantially carried out according to the position feedback control for each elapsed time from the start of injection, the deceleration is not started by detection of the predetermined position.

Third Modification

Control according to a third modification is shown by FIG. 10B in the same way as the above second modification.

As explained in the second modification, the deceleration start position may be set by using the function of setting the injection speed with respect to the position of the plunger 41 in the usual die casting machine which does not perform pressing after the injection. On the other hand, as already explained, there is a die casting machine in which the position feedback control for each elapsed time from the start of injection is carried out based on the signal from the position sensor 89, and the speed feedback control for the plunger 41 is substantially carried out by this. When these two are combined, the injection control part 93 does not start the deceleration when detecting the deceleration start position based on the signal from the position sensor 89, but starts the deceleration when detecting that a predetermined period of time has passed from the start of injection (predetermined point of time) (detecting that a point of time corresponding to the deceleration start position (for example t6 in FIG. 7B comes) has arrived).

Note that, the configuration and operation in the third modification are the same as those in the second modification except that the concrete information for detecting the arrival of the plunger 41 at the deceleration start position is not the position detected by the position sensor 89, but the elapsed time which is counted by the injection control part 93 from the start of injection.

Fourth Modification

Control according to a fourth modification is also shown by FIG. 10B. As explained with reference to FIG. 7A, even in the state where the injection control part 93 is performing the control so that the plunger 41 advances toward the die 101 at the predetermined target speed V1 (even if the deceleration control is not carried out), when the semi-solidified metal is substantially filled in the die 101, the plunger 41 decelerates by the force received from the semi-solidified metal.

Therefore, in the fourth modification, in a state where control is carried out so that the speed of the plunger 41 becomes the target speed V1, the injection control part 93 starts the control for decelerating the plunger 41 when detecting based on the signal from the position sensor 89 (speed sensor) that the speed of the plunger 41 has fallen to a predetermined deceleration starting speed Vs (FIG. 7A) which is lower than the target speed V1. Note that, the configuration and operation in the fourth modification may be the same as those in the embodiment except that the electrical connection sensor 73 does not have to be provided and the starting condition of deceleration control is the speed of the plunger 41.

The deceleration starting speed is stored in the data DT and referred to by the injection control part 93. Further, the deceleration starting speed may be for example set by the manufacturer of the die casting machine 1 or set by the input setting part 99 by operation by the operator of the input device 51 or may be set by the control device 47 which automatically sets a speed which is lower than the target speed V1 by a predetermined amount or ratio as the deceleration starting speed.

Fifth Modification

Figure 10C:
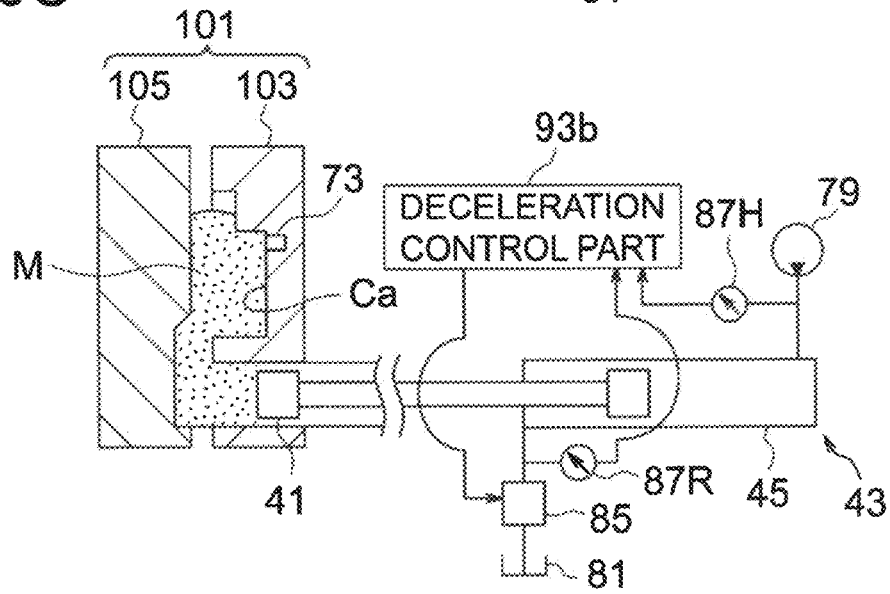

FIG. 10C is a diagram corresponding to FIG. 8B according to a fifth modification and schematically shows the control when starting the deceleration of the plunger 41.

As explained with reference to FIG. 7A, in the state where the injection control part 93 is performing control so that the plunger 41 advances toward the die 101 at the predetermined target speed V1, if the semi-solidified metal is substantially filled in the die 101, the injection pressure relatively drastically rises.

Therefore, in the fifth modification, in the state where control is carried out so that the speed of the plunger 41 becomes the target speed V1, the injection control part 93 starts the control for decelerating the plunger 41 at the time when it detects based on the signal from the pressure sensor 87 (combination of 87H and 87R or only 87H) that the injection pressure has risen up to the predetermined deceleration starting pressure Ps (FIG. 7A). Note that, the configuration and operation in the fifth modification may be the same as those in the embodiment except that the electrical connection sensor 73 does not have to be provided and the starting condition of deceleration control is the injection pressure.

The deceleration starting pressure is stored in the data DT and is referred to by the injection control part 93. Further, the deceleration starting pressure may be for example set by the manufacturer of the die casting machine 1, set by the input setting part 99 by operation by the operator of the input device 51, or automatically set by the control device 47 based on the target speed V1 or the like.

Note that, in the embodiment (judgment of conduction of current), first modification (judgment of temperature), second modification (judgment of position), and third modification (judgment of time), the deceleration control may be started at either of the time before occurrence of a rise of the injection pressure (rise after the point of time t2 in FIG. 7A) by filling of the semi-solidified metal (solid-liquid coexisting metal) into the die 101 coming near completion or the time after when a rise begins (for example immediately after the rise). Preferably, the position of the sensor or judgment conditions are set so that the deceleration control is started before occurrence of a rise.

(Modification of Pressing Starting Condition)

In the embodiment, as explained with reference to FIG. 8C, the pressing starting condition (step ST7) was made the detection temperature of the temperature sensor 75 falling to a predetermined pressing start temperature. However, various pressing starting conditions other than this are possible.

For example, although not particularly shown, the pressuse clamping control part 95 may start the pressing at the time when an elapsed time from a suitable starting point of time of counting reaches the predetermined pressing starting point of time as well. The starting point of time of counting may be suitably set. For example, it may be the starting point of time of injection or the point of time when the deceleration of the plunger 41 is started or may be the point of time when the plunger 41 stops. Also the starting point of time of pressing (from another viewpoint, the elapsed time from the starting point of time of counting) may be suitably set. For example, it may be the point of time at which it is estimated the plunger 41 will stop or may be the point of time at which it is estimated the viscosity of the semi-solidified metal will become high to a certain extent.

The starting point of time of counting and/or the starting point of time of pressing is held in the data DT and is referred to by the press-use clamping control part 95. The starting point of time of counting and/or the starting point of time of pressing for example may be set by the manufacturer of the die casting machine 1, set by the input setting part 99 by operation by the operator of the input device 51, or automatically set by the control device 47 based on suitable information.

Further, although not particularly shown, use can be also made of an indicator used for the deceleration starting condition for the pressing starting condition. For example, the press-use clamping control part 95 may start the pressing when detecting the conduction of current based on a signal from the electrical connection sensor 73 as well. Note that, the electrical connection sensor 73 in this case may be the same as or different from that used for the judgment of the deceleration starting condition. Further, for example, the press-use clamping control part 95 may start pressing when detecting based on the signal from the position sensor 89 that the plunger 41 reaches the predetermined pressing start position. Further, for example, the press-use clamping control part 95 may start the pressing when detecting that the injection pressure has risen up to the predetermined pressing starting pressure based on the signal from the pressure sensor 87 (combination of 87H and 87R or only 87H) as well.

Note that, in the embodiment, the point of time of starting of pressing the semi-solidified metal (start of movement of the moving die plate 17) is made the time when the temperature of the semi-solidified metal falls to a predetermined pressing start temperature. As a result, in FIG. 7B, the pressing is started after the semi-solidified metal is substantially filled in the die 101 (after the point of time t6 or after t2). Note, in various modifications described above, so far as the semi-solidified metal can be pressed by the die 101, the starting point of time may be before, equal to, or after the starting point of time of pressing shown in the embodiment.

For example, at the extreme, the starting point of time of pressing may be after the start of injection (after t0) or after the middle point of time of injection (after (t2−t0)/2 in FIG. 7B), and can be before the start of injection (before t0). Note, where the pressing is started in an early stage, it is necessary to make the speed of pressing relatively low so that die contact will not occur in an early stage with respect to the injection.

Realistically, the point of time of start of pressing is for example the point of time immediately before the deceleration starting point of time (t6) of the plunger 41, a suitable point of time during the period from the point of time of start of deceleration to when the plunger 41 substantially stops (t6 to t2), and a suitable timing after the plunger 41 substantially stops (after t2 in FIG. 7B).

From the viewpoint of reliably pressing the semi-solidified metal by the die 101, the pressing starting point of time is preferably after the deceleration starting point of time (t6) and further preferably after the point of time of stopping of the plunger 41 (t2 in FIG. 7B).

The deceleration starting conditions in the embodiment and first to fifth modifications and the pressing starting conditions according to the various modifications explained above may be suitably combined. For example, by combining any of the deceleration starting conditions according to the third to fifth modifications and the pressing starting condition using any of the elapsed time (timer), the position sensor 89 and pressure sensor 87, it is also possible to make the electrical connection sensor 73 and temperature sensor 75 unnecessary.

Second Embodiment

Figure 11:
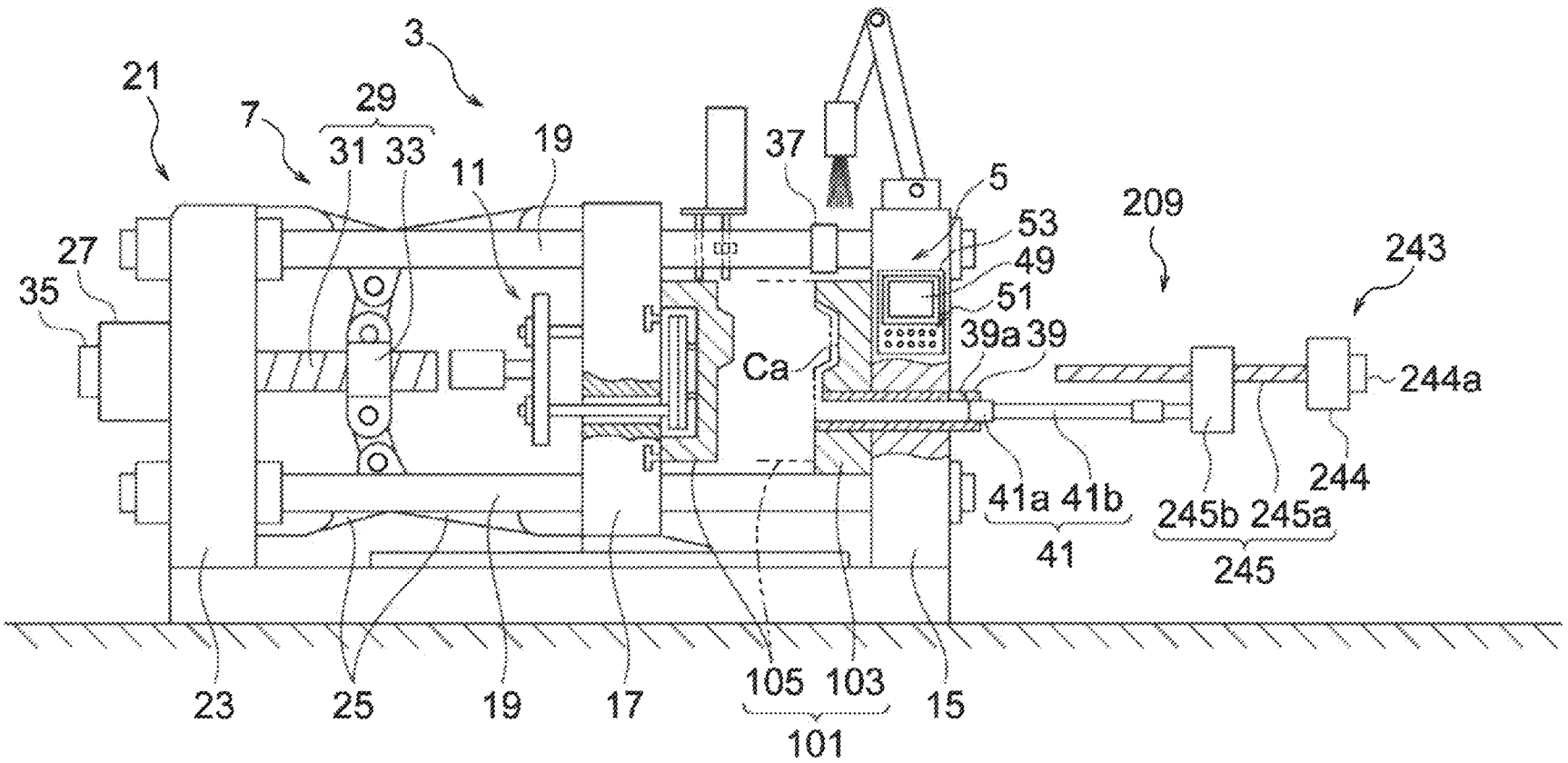
FIG. 11 is a side view showing the configuration of a principal part of a die casting machine according to a second embodiment.

FIG. 11 is a diagram corresponding to FIG. 1 and shows the configuration of the principal part of a die casting machine 201 according to a second embodiment.

In the first embodiment, the injection driving part 43 in the injection apparatus 9 is a hydraulic type. Contrary to this, in the second embodiment, an injection driving part 243 in an injection apparatus 209 is an electric type. The points other than this in the second embodiment are the same as those in the first embodiment.

The electric injection driving part 243 may be configured in various ways. In the illustrated example, the injection driving part 243 has a rotary electric motor 244 and a transmission mechanism 245 which converts the rotation of the electric motor 244 to translation motion and transmits this to the plunger 41.

The transmission mechanism 245 is for example configured by a screw mechanism and has a screw shaft 245*a* and a nut 245*b* screwed with the screw shaft 245*a*. In the screw shaft 245*a*, for example, movement in the axial direction is restricted and rotation around the axis is permitted. Rotation of the electric motor 244 is transmitted to this. The nut 245*b* is for example permitted in the movement in the axial direction and is restricted in rotation around the axis and is connected to the plunger 41. Further, when the screw shaft 245*a* is rotated around the axis by the electric motor 244, the nut 245*b* moves in the axial direction and in turn the plunger 41 advances or retracts.

The operation of the die casting machine 201 is basically the same as that in the first embodiment (and various modifications thereof). Note, this is an electric type, therefore the speed control and pressure (torque) control are carried out according to the current, voltage, and/or frequency of power (DC or AC) supplied to the electric motor 244.

Further, concerning the speed feedback control, judgment of deceleration starting condition, and/or judgment of pressing starting condition, an encoder 244*a* of the electric motor 244 may be used as well in place of the position sensor 89. Note that, the encoder 244*a* may be grasped as a kind of position sensor capable of detecting the position of the plunger 41 as well. The encoder 244*a* may be used as the speed sensor in the same way as the position sensor 89.

The electric injection driving part 243 is not provided with a pressure sensor 87. However, concerning the judgment of the deceleration starting condition and/or judgment of the pressing starting condition, the injection pressure may be for example specified based on the torque generated by the electric motor 244. The detection of torque for example may be measured based on the consumed power or measured according to detection of displacement or deformation which occurs between a drive shaft and a load shaft.

In the second embodiment as well, in the same way as the first embodiment, the injection is started in the vicinity state where the pair of die halves 101 are made to face each other over the gap "d", the pressing is carried out by clamping after the start of injection, and the injection is ended by performing control for decelerating the plunger at the time of injection, therefore the same effects as those by the first embodiment are exerted. That is, an improvement of quality by densifying the metal structure is obtained, and formation of burrs can be suppressed (from another viewpoint, the gap "d" can be made larger).

Further, in the second embodiment, the injection apparatus 209 is configured as an electric type. In the usual injection apparatus for injecting molten metal, in order to realize high speed injection for smoothly injecting the molten metal, a configuration having an injection cylinder and an accumulator for supplying hydraulic fluid to the injection cylinder is frequently employed. In particular, in a large-sized die casting machine, it is difficult to configure the injection apparatus as an electric type. However, when predicated on a semi-solidified metal, it is made easier to employ an electric type injection apparatus 209 as in the present embodiment. Further, it is made easier to configure the entire die casting machine 201 as an electric type.

The present invention is not limited to the above embodiments and modifications and may be executed in various ways.

For example, the die casting machine is not limited to a horizontal clamping/horizontal injection and may be a vertical clamping and/or vertical injection type. The die casting machine may be one that can perform not only casting of semi-solidified metal, but also casting of molten metal or may be dedicated to casting of a solid-liquid coexisting metal which cannot perform casting of molten metal.

The driving part in the clamping device is not limited to an electric type and may be a liquid pressure type (oil pressure type) as well. Note, from the viewpoint of making the pair of die halves face each other over a correct prescribed gap, the driving part in the clamping device is preferably an electric type. Further, the clamping device is not limited to a toggle type and may be a so-called direct pressure type or so-called composite type in which opening/closing and clamping of the die are carried out by different driving parts. The tie bars may be fixed to the moving die plate and be able to move relative to the fixed die plate converse to the embodiment.

The driving part in the injection apparatus may be a liquid pressure type or electric type as explained also in the embodiment. Further, it may be a hybrid type combining the two as well. The driving part in the injection apparatus need not have an accumulator in the case of the liquid pressure type. This is because when just casting a semi-solidified metal, it is not necessary to drive the injection cylinder at a high speed. The driving part in the injection apparatus may be one using a linear motor in the case of an electric type as well. Further, when using a rotary type motor, the mechanism of converting the rotation to translation motion is not limited to a screw mechanism, but may be for example a rack and pinion mechanism as well. Further, when a screw mechanism is used, the screw shaft may be connected to the plunger and the nut may be rotated.

The combination of the configuration of the driving part in the clamping device and the driving part in the injection apparatus is also suitable. For example, use may be made of a full electric power type (second embodiment) in which the two are configured as electric power types or a full hydraulic type in which the two are configured as hydraulic types or a hybrid type (for example first embodiment) in which either is configured as the electric power type and the other is configured as the hydraulic type.

The speed of the plunger may be partially or wholly controlled by open control as well. Note that, even in the case of open control, as in the third modification, the deceleration may be started at the time when time having a predetermined period has elapsed from a predetermined point of time (usually start of injection).

Priority is claimed on Japanese application No. 2016-94766, filed on May 10, 2016, the content of which is incorporated herein by reference.

REFERENCE SIGNS LIST

1 . . . die casting machine, 7 . . . clamping device, 9 . . . injection apparatus, 39 . . . sleeve, 41 . . . plunger, 47 . . . control device, 93 . . . injection control part, 95 . . . press-use clamping control part, and 101 . . . die.

The invention claimed is:

1. A die casting machine comprising:

a clamping device configured to open and close and clamp a pair of die halves;

an injection apparatus configured to perform injection to the pair of die halves by moving a plunger forward in a sleeve communicated with a space between the pair of die halves;

an electrical connection sensor configured to output a signal in accordance with conduction of current at a predetermined position in the die halves; and a control device configured to control the clamping device and the injection apparatus, the control device comprising a processor circuit configured to:

control the injection apparatus so that the injection is started in a state where the pair of die halves face each other through a gap and so that the plunger is decelerated before the plunger stops, control the clamping device so that a contact and clamping are carried out after the start of injection, and start control for decelerating the plunger in response to detecting the conduction of current based on a signal from the electrical connection sensor.

2. The die casting machine according to claim 1, wherein the processor circuit is configured to perform control for decelerating the plunger before a rise of injection pressure due to filling of a solid-liquid coexisting metal into the space between the pair of die halves approaching completion.

3. The die casting machine according to claim 1, wherein the processor circuit is configured to perform control for stopping the plunger as the control for decelerating the plunger.

4. The die casting machine according to claim 1, wherein the die halves form a product part and an overflow part inside the product part, and the predetermined position is a position in the overflow part which is separated from the end part of the overflow part toward a product part side.

5. The die casting machine according to claim 1, further comprising a temperature sensor configured to output a signal in accordance with a temperature in a product part of the die halves, wherein the processor circuit is configured to start the control for die contact and clamping in response to detecting a drop in the temperature in the product part down to a predetermined pressing start temperature based on the signal from the temperature sensor.

6. A die casting machine comprising:

a clamping device configured to open and close and clamp a pair of die halves;

an injection apparatus configured to perform injection to the pair of die halves by moving a plunger forward in a sleeve communicated with a space between the pair of die halves;

a position sensor configured to output a signal in accordance with the position of the plunger; and a control device configured to control the clamping device and the injection apparatus, the control device comprising a processor circuit configured to:

control the injection apparatus so that the injection is started in a state where the pair of die halves face each other through a gap and so that the plunger is decelerated before the plunger stops, control the clamping device so that a contact and clamping are carried out after the start of injection, and start control for decelerating the plunger in response to detecting that the position of the plunger reaches a predetermined deceleration start position based on the signal from the position sensor.

7. The die casting machine according to claim 6, wherein the processor circuit is configured to perform control for decelerating the plunger before a rise of injection pressure due to filling of a solid-liquid coexisting metal into the space between the pair of die halves approaching completion.

8. The die casting machine according to claim 6, wherein the processor circuit is configured to perform control for stopping the plunger as the control for decelerating the plunger.

* * * * *